US006166651A

United States Patent [19]

Kushita

[11] Patent Number: 6,166,651

[45] **Date of Patent: *Dec. 26, 2000**

[54] RADIO SELECTIVE CALLING RECEIVER HAVING AUTOMATIC TIME CORRECTION FUNCTION

[75] Inventor: Masayuki Kushita, Tokyo, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/992,651

[22] Filed: Dec. 17, 1997

[30] Foreign Application Priority Data

Dec. 18, 1996 [JP] Japan ..... 8-337386

[51] Int. Cl.[7] ..... G08B 5/22

[52] U.S. Cl. ..... 340/825.44; 455/38.1

[58] Field of Search ..... 340/825.44, 825.47, 340/825.49, 825.57, 309.4; 368/10, 185, 47; 702/178; 455/38.1, 502

[56] References Cited

U.S. PATENT DOCUMENTS

| | | | |
|---|---|---|---|
| 5,040,158 | 8/1991 | Lee et al. | 368/10 |
| 5,043,718 | 8/1991 | Shimura | 340/825.44 |
| 5,150,954 | 9/1992 | Hoff | 340/825.44 |
| 5,363,377 | 11/1994 | Sharpe | 340/825.44 |

FOREIGN PATENT DOCUMENTS

| | | |
|---|---|---|
| 0 461 849 A2 | 12/1991 | European Pat. Off. . |
| 0 565 180 A2 | 10/1993 | European Pat. Off. . |
| 0 640 897 A1 | 3/1995 | European Pat. Off. . |
| 0 693 854 A2 | 1/1996 | European Pat. Off. . |
| 1 673 796 | 4/1971 | Germany . |
| 4-230890 | 8/1992 | Japan . |
| 2 245 399 | 1/1992 | United Kingdom . |

OTHER PUBLICATIONS

Patent Abstracts of Japan, vol. 014, No. 200 (E–0920), Apr. 24, 1990 and JP 02 041047 A (Nippon Hoso Kyokai), Feb. 9, 1990;.

Patent Abstracts of Japan, vol. 096, No. 009, Sep. 30, 1996, & JP 08 136675 A (Nippon Signal Col. Ltd: The), May 31, 1996.

*Primary Examiner*—Michael Tokar
*Assistant Examiner*—Jean B. Jeanglaude
*Attorney, Agent, or Firm*—Scully, Scott, Murphy & Presser

[57] ABSTRACT

A radio selective calling receiver for receiving a signal containing reference time information representing a reference time, including: a timepiece unit for indicating a time; a comparison circuit for comparing the reference time represented by the received signal with the time indicated by the timepiece unit; and a time correction section for correcting the time indicated by the timepiece unit on the basis of the reference time only when a time difference value obtained upon comparison is not more than a predetermined set value.

11 Claims, 21 Drawing Sheets

1 SEQUENCE
(60 CYCLES)

00
01
02
03
04
05
---
56
57
58
59
1 CYCLES
(5 SUBSEQUENCES)

0
1
2
3
4
1 SUBSEQUENCE
(12 BATCHES)

00
01
02
03
04
05
06
07
08
09
10
11
1 BATCH
(100 WORD)

SYNCHRONIZATION WORD FIELD
---
FRAME INFORMATION FIELD
---
TIME INFORMATION FIELD
---
INDIVIDUAL NUMBER CODE FIELD
MESSAGE CODE FIELD

"SECOND" INFORMATION
"MINUTE" INFORMATION
"HOUR" INFORMATION

PREANBLE WORD
SYNCHRONIZATION WORD
FIRST WORD
SECOND WORD

RADIO SELECTIVE CALLING RECEIVER HAVING AUTOMATIC TIME CORRECTION FUNCTION

BACKGROUND OF THE INVENTION

1. Field of the Invention

The present invention relates to a radio selective calling receiver and, more particularly, to a radio selective calling receiver having an automatic time correction function capable of automatically correcting the time indicated by an internal timepiece using time information contained in the received signal format.

2. Description of the Prior Art

Some conventional radio selective calling receivers having a timepiece function have a function of automatically correcting the time indicated by an internal timepiece using time information (information representing the time generated from a base station) in the received signal format.

Japanese Unexamined Patent Publication No. 4-230890 discloses a radio selective calling receiver incorporating two timepieces for counting two different times with a time difference and having a function of correcting one of the timepieces on the basis of any deviation from the received reference time information. As shown in FIG. 1, this radio selective calling receiver determines received reference time information first (step (to be abbreviated as ST hereinafter) 191). If the time data is normal (the data has neither an error nor a value outside the range of time information), the first timepiece is corrected using the received reference time information (ST192). Next, information of "second" unit or less of the second timepiece is corrected on the basis of the received reference time information (ST194). In addition, information of "minute" unit or more of the second timepiece is corrected on the basis of the deviation between the reference time information and the first time (value before correction in ST192). In ST195 and ST196, the time counting operations of the first and second timepieces are continued, respectively. The contents of a selected timepiece (ST197) are displayed/output (ST198).

In the above-described prior art, in determining the received time information (reference time information), it is detected only whether the data has a bit error or a value outside the range of time information. For this reason, when the received reference time information has no bit error but a value that has changed within the range (replaced with another code due to a bit error), the time of the internal timepiece is erroneously corrected.

In the BCH (31 or 21) code which is a block error correction code often used for radio selective calling, the intercode distance (Hamming distance) is five. A bit error of two or less bits can be detected and corrected, although an error of three or more bits may be replaced with another code within the range of a 2-bit error (replacement with another code due to a bit error will be simply referred to as a "change" hereinafter).

In the conventional signal scheme, a binary signal is modulated and transmitted. However, along with a recent increase in transfer rate of radio selective calling, as a means of increasing the transfer rate, a technique of modulating a quarternary signal and transmitting the modulated signal, as shown in FIG. 2, is becoming popular. The transmission signal shown in FIG. 2 is a quarternary signal (00, 01, 11, 10). This value is compared with a predetermined frame synchronization signal pattern, thereby detecting synchronization. In the example shown in FIG. 2, the frame synchronization signal pattern is "10, 00, 10, 10, 00, 10, 00, 00, 10, 10, 00, 00, 10, 10, 10". The same pattern as this frame synchronization signal pattern is detected from the transmission signal, and a synchronization signal detection signal is sent at the end timing of the pattern.

In this case, the quarternary signal is divided into an MSB (Most Significant Bit) and an LSB (Least Significant Bit). When the value of the MSB changes as "1, 0, 1, 1, 0, 1, 0, 0, 1, 1, 0, 0, 1, 1, 1" and the value of the LSB does not change from "0", a synchronization signal detection signal can be detected. This state is shown in FIG. 2. The value of the MSB changes as described above, and the value of the LSB remains "0".

FIG. 3 is a block diagram showing a specific arrangement for detecting the frame synchronization signal pattern. As shown in FIG. 3, the MSB of the transmission signal is input to a 15-bit shift register 22, and at the same time, the LSB is input to a 15-bit shift register 23. A frame synchronization signal pattern generation unit 21 sends a frame synchronization signal pattern whose value changes as described above. A pattern matching circuit 24 compares the sent frame synchronization signal pattern with outputs from the 15-bit shift registers 22 and 23.

When the comparison result from the pattern matching circuit 24 reveals coincidence, detection of a frame synchronization signal pattern is determined, so a synchronization detection signal S106 is sent. To break up the quarternary signal into the MSB and LSB, level detection may be performed by an A/D converter.

In transmission of the quaternary signal, a preamble signal used to detect the intermediate level of the signal or detect bit synchronization, or a frame synchronization signal used to detect frame synchronization has only the highest and lowest levels of the quarternary signal, so it is substantially equivalent to a binary signal. For this reason, when the sensitivity of the receiver is not so high after establishment of frame synchronization, four-bit reference time information next to the frame synchronization signal is likely to be received with an error or change although the frame synchronization signal pattern can be detected.

In the above-described prior art, when the receiver user wants to intentionally set a time shifted from the reference time in the internal timepiece, the receiver must incorporate a plurality of timepiece functions. The plurality of timepiece functions increase the scale of the internal circuit, or an increase in CPU processing results in an increase in entire current consumption of the receiver. This is a serious disadvantage for the radio selective calling receiver driven by a battery.

In addition, the user cannot arbitrarily enable/disable time correction of the internal timepiece on the basis of the received reference time information.

SUMMARY OF THE INVENTION

The present invention has been made to solve the problems of the above-described prior art, and has as its object to provide a radio selective calling receiver which does not correct an internal timepiece on the basis of reference time information estimated to have a value changed within a predetermined range, can always set a time shifted from the reference time by one timepiece function, and also allows the user to enable/disable the internal timepiece correction function based on the received reference time information.

In order to achieve the above object, according to the basic aspect of the present invention, there is provided a radio selective calling receiver for receiving a signal containing reference time information representing a reference time, comprising timepiece means for indicating a time, comparison means for comparing the reference time represented by the received signal with the time indicated by the timepiece means, and time correction means for correcting the time indicated by the timepiece means on the basis of the reference time only when a time difference value obtained upon comparison is not more than a predetermined set value.

That is, this radio selective calling receiver compares the reference time represented by the received signal with the time indicated by the internal timepiece, and only when the time difference value obtained upon comparison is not more than the predetermined set value, corrects the time indicated by the internal timepiece function on the basis of the reference time.

More specifically, the radio selective calling receiver of the present invention compares the received reference time with the current time information indicated by the timepiece function. When the value of the difference between the two time information is larger than the predetermined set value, the current time indicated by the timepiece function is not corrected. When the value of the difference between the two time informations is smaller than the predetermined set value, the current time indicated by the timepiece function is corrected on the basis of the reference time. For this reason, unless the time of the internal timepiece does not largely vary, the internal timepiece is not corrected on the basis of received time information which can be estimated to have a value changed within a predetermined range.

The present invention also has the following subsidiary aspects.

(1) Even when the value of the difference between the received time information and the current time information indicated by the timepiece function obtained upon comparison is larger than the predetermined value, when the difference value falls within a predetermined error range continuously a predetermined number of times in subsequent time information reception, the current time indicated by the timepiece function is corrected at that time point on the basis of the reference time. With this arrangement, even when the time of the internal timepiece largely varies, the internal timepiece can be corrected on the basis of the reference time information as far as the reference time information is normally received.

(2) Even when the value of the difference between the received time information and the current time information indicated by the timepiece function obtained upon comparison is larger than the predetermined value, only "second" information of the current time indicated by the timepiece function is corrected on the basis of the reference time. Even when the received "hour" or "minute" information has changed within a predetermined range, the time of the internal timepiece varying in units of seconds, can be corrected as far as the "second" information is normal. Even when the received "second" information has changed, the variation of the internal timepiece from the normal reference time is one minute at maximum, so the influence is not so large.

(3) To cope with a case wherein each frame in the received signal format is synchronized with the standard time in each of 24 time zones where a base station or cell site is located, as in Europe, a frame synchronization signal is detected, frame information next to this frame synchronization signal is detected and acquired, and time information is detected and acquired. When the value of the difference between the acquired time information and the current time information indicated by the timepiece function is larger than the predetermined value, the current time indicated by the timepiece function is not corrected on the basis of the frame information. When the value of the difference between the two time information is not more than the predetermined value, the current time indicated by the timepiece function is corrected on the basis of the reference time information. With this arrangement, even when the received reference time information has an error or a value that has changed within a predetermined range, the time of the internal timepiece can be corrected on the basis of the frame information as far as the frame information is normally received.

(4) An offset value which is the difference between the time indicated by the timepiece function and a standard time in a pertinent one of 24 time zones is stored, and the current time indicated by the timepiece function is corrected on the basis of the stored contents. With this arrangement, a time shifted from the reference time can always be set using one timepiece function.

(5) When a message for the self receiver is received, a time corresponding to time information obtained by subtracting the offset value from the current time indicated by the timepiece function or time information obtained by adding the offset value to the current time is stored as an individual message reception time. As the individual reception time of the received message, a time corresponding to the reference time or a time shifted from the reference time, as in the internal timepiece, can be stored.

(6) Since the automatic time correction is enabled/disabled by external control, the receiver user can arbitrarily enable/disable the internal timepiece correction function based on the received reference time information.

(7) The comparison means of the basic aspect comprises means for obtaining a difference between the reference time represented by the reference time information contained in at least one specific frame or plural frames of the signal and the time indicated by the timepiece means, and means for changing the specific frame to another frame or other frames when the obtained time difference value is larger than the set value.

In the present invention having the above basic and subsidiary aspects, since time correction is performed on the basis of the result of comparison between the received time information and the time information of the internal timepiece, the reliability of the internal timepiece can be improved.

In addition, when a time shifted from the reference time is to be intentionally set, an offset value is stored instead of incorporating a plurality of timepieces, so the current consumption can be prevented from increasing.

Furthermore, by arranging the switching function of enabling/disabling the internal timepiece correction, the internal timepiece correction function can have flexibility.

The above and many other objects, features and advantages of the present invention will become manifest to those skilled in the art upon making reference to the following detailed description and accompanying drawings in which preferred embodiments incorporating the principles of the present invention are shown by way of illustrative examples.

BRIEF DESCRIPTION OF THE DRAWINGS

FIGS. 6A and 6B are timing charts showing examples of bit correction using a preamble signal, in which FIG. 6A shows a case wherein a change point t1 of a transmission preamble signal is detected while the internal symbol rate clock is at low level, and FIG. 6B shows a case wherein the change point t1 of the transmission preamble signal is detected while the internal symbol rate clock is at high level;

DETAILED DESCRIPTION OF THE PREFERRED EMBODIMENTS

Preferred embodiments of the present invention will be described below in detail with reference to the accompanying drawings.

Figure 4:
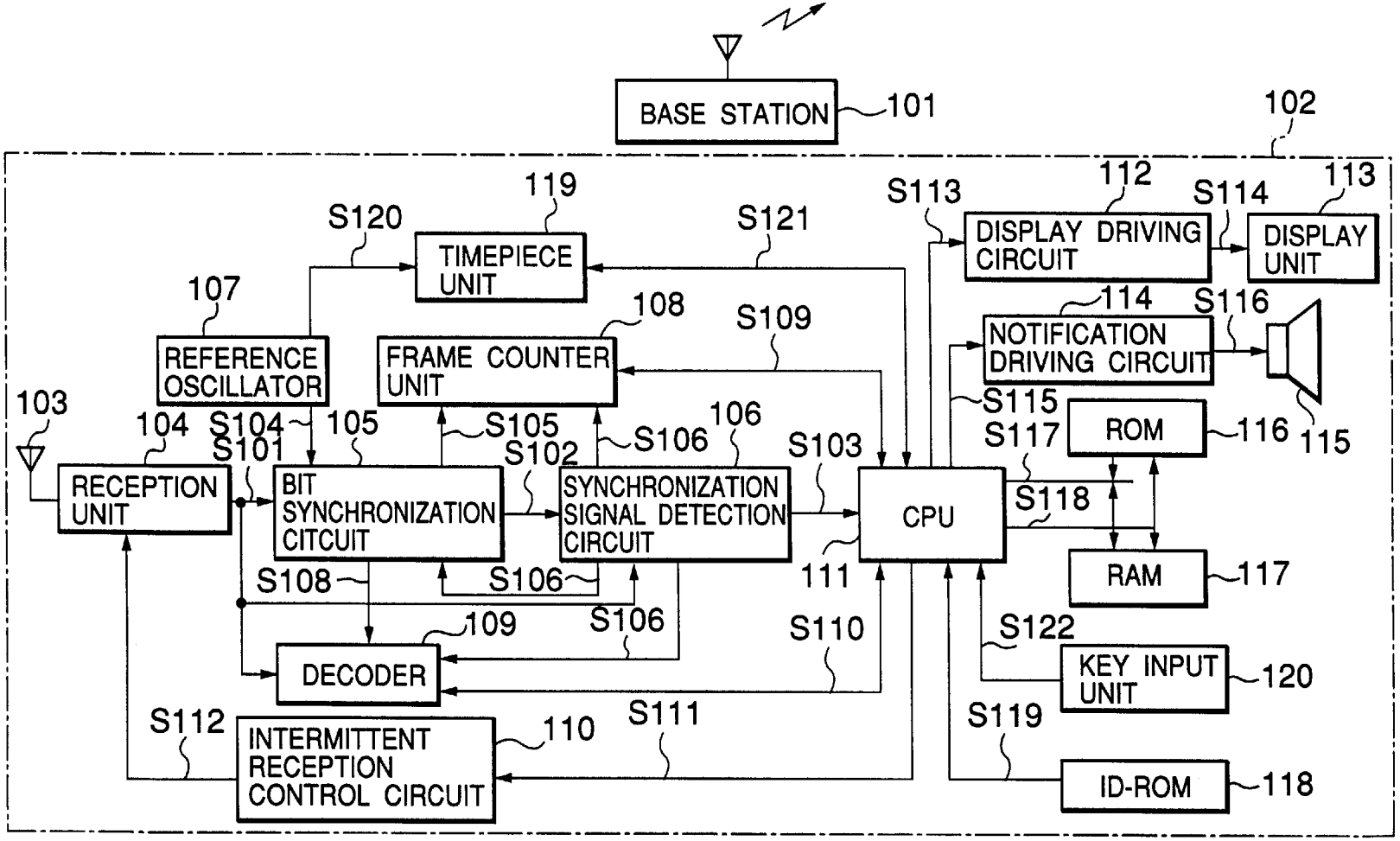
FIG. 4 is a block diagram showing the schematic arrangement of a radio selective calling receiver according to the first embodiment of the present invention.

FIG. 4 is a block diagram showing the schematic arrangement of a radio selective calling receiver according to the first embodiment of the present invention. In FIG. 4, a battery for supplying an operating voltage to the respective portions and a boost circuit are not illustrated.

Referring to FIG. 4, a base station or cell site 101 transmits a transmission signal based on a predetermined format shown in FIGS. 5A to 5F to a receiver 102.

Figures 5A, 5B, 5C, 5D, 5E, 5F:
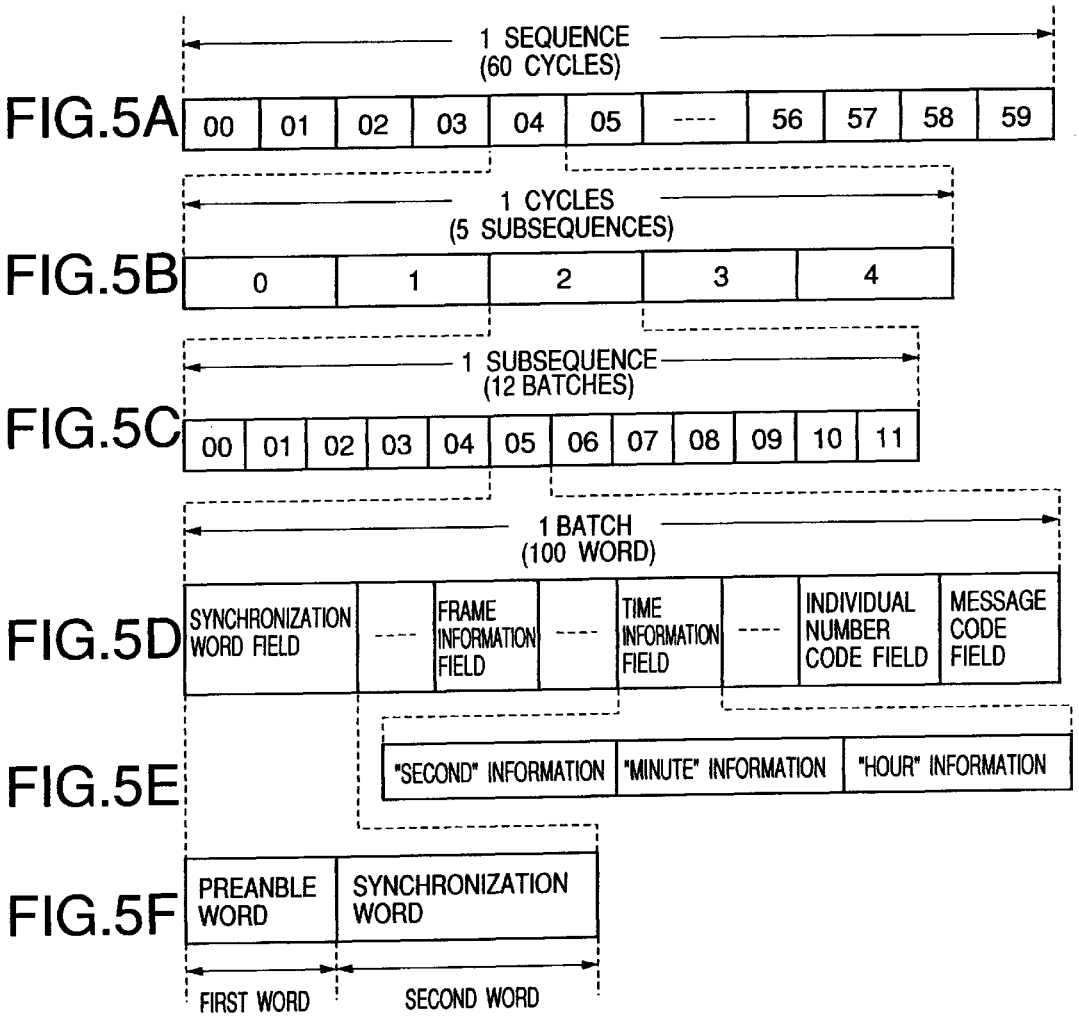
FIGS. 5A to 5F are views showing the format of a synchronization signal received by the radio selective calling receiver shown in FIG. 4.

Referring to FIG. 5A, one sequence is constituted by 60 cycles from "00" to "59".

Referring to FIG. 5B, one of the 60 cycles of one sequence, e.g., cycle "04" is constituted by five subsequences from "0" to "4".

Referring to FIG. 5C, one of the five subsequences, e.g., subsequence "05" is constituted by 12 batches from "00" to "11".

Referring to FIG. 5D, one of the 12 batches is constituted by 100 words. More specifically, as shown in FIG. 5D, one batch is constituted by a synchronization word field, a frame information field, a time information field, an individual number code field, and a message code field.

Referring to FIG. 5F, the synchronization word field is constituted by the first word, i.e., a preamble word, and the second word, i.e., a synchronization word.

Referring to FIG. 5E, the time information field is constituted by "second" information, "minute" information, and "hour" information. Each of the "second" information and "minute" information has 6 bits. The valid values are "0" to "59", and values outside the range are "60" to "63". The "hour" information has five bits. The valid values are "0" to "23", and values outside the range are "24" to "31".

Referring back to FIG. 4, a reception antenna 103 receives the transmission signal from the base station 101 and supplies the received signal to a reception unit 104.

The reception unit 104 amplifies, demodulates, and shapes the received signal and outputs a demodulated signal S101 to a bit synchronization circuit 105, a synchronization signal detection circuit 106, and a decoder 109.

Figure 6A:
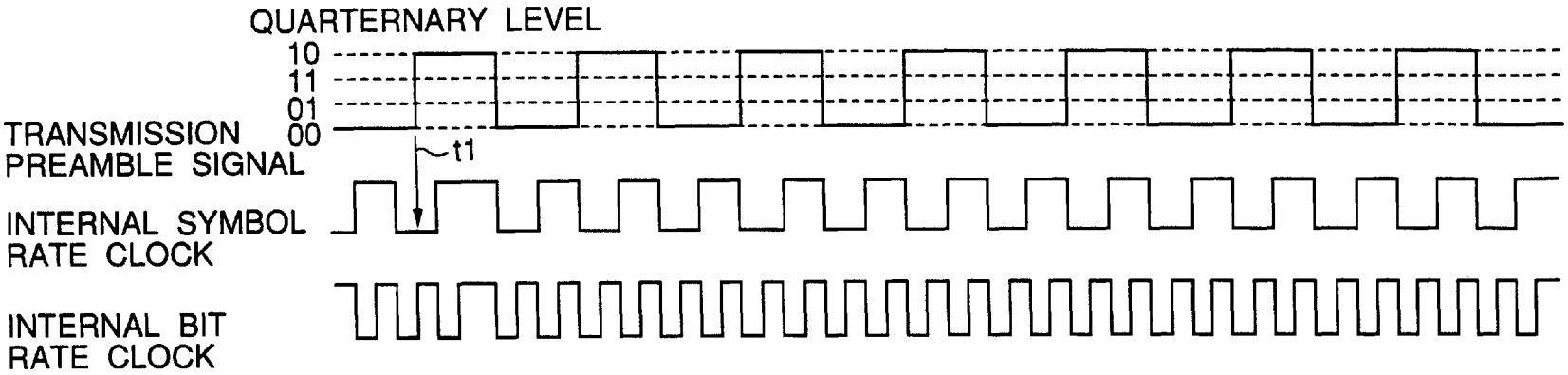
Figure 6B:
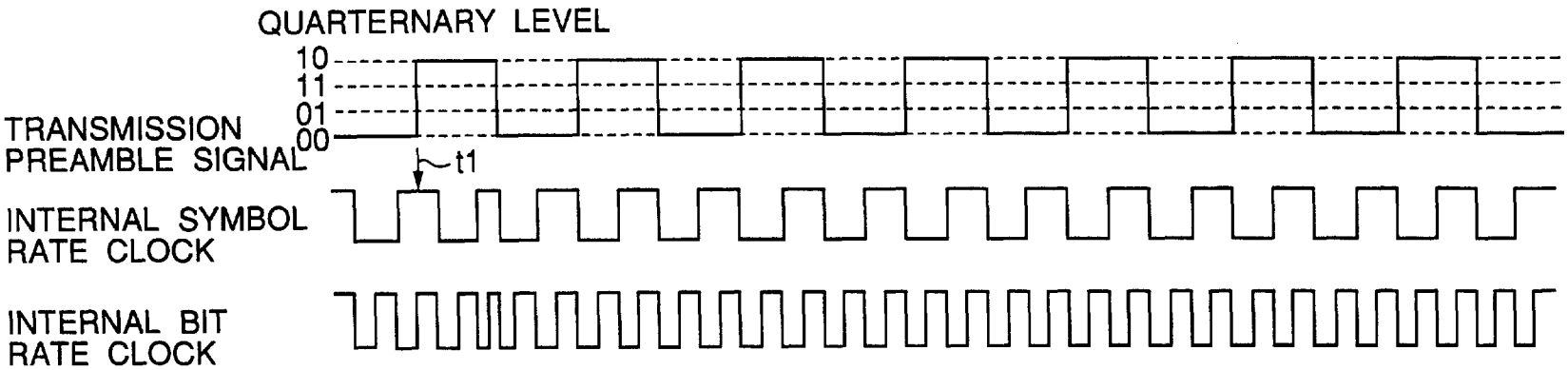

The bit synchronization circuit 105 divides a clock (S104) supplied from a reference oscillator 107 to generate bit rate and symbol rate clocks, and adjusts the phase of the generated clock to make it match that of the transmission signal using a preamble signal or the like (this adjustment will be referred to as bit correction hereinafter) as needed, as shown in FIGS. 6A and 6B.

Each of FIGS. 6A and 6B shows a transmission preamble signal as a received signal, an internal bit rate clock, and a symbol rate clock which has level transition at the trailing edge timing of the bit rate clock.

As shown in FIG. 6A, when a change point t1 of the transmission preamble signal is detected while the internal symbol rate clock is at low level, the high level period of the next symbol rate clock is extended by a fixed width. For example, the clock is forcibly stopped for a time corresponding to 1/32 symbol width. Consequently, the high level period of each of the internal symbol rate clock and internal bit rate clock immediately after the change point t1 becomes longer than that of the remaining clocks.

On the other hand, as shown in FIG. 6B, when the change point t1 of the transmission preamble signal is detected while the internal symbol rate clock is at high level, the high level period of the next symbol rate clock is shortened by a fixed width. For example, a clock having a pulse width corresponding to 1/32 symbol width is inserted. As a result, each of the internal symbol rate clock and internal bit rate clock immediately after the change point t1 has a pulse shorter than the remaining pulses.

The bit synchronization circuit 105 performs bit correction as described above. The preamble signal has 30 bits, i.e., in this example, "00, 10, 00, 10, 00, 10, 00, 10, 00, 10, 00, 10, 00, 10, 00".

Figure 7:
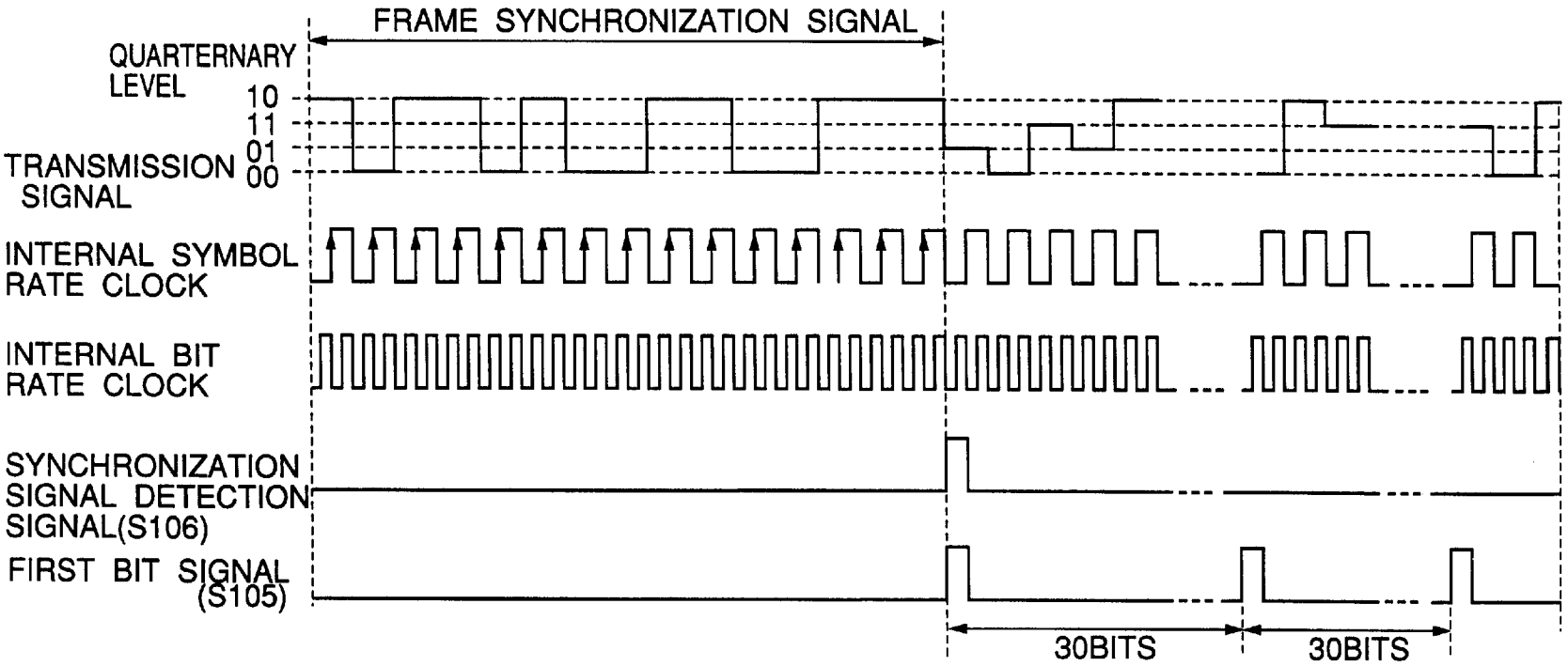
FIG. 7 is a timing chart showing the operation in the receiver before and after detection of the frame synchronization signal.

The synchronization signal detection unit 106 extracts the demodulated signal from the reception unit 104 using a bit-corrected clock S102 supplied from the bit synchronization circuit 105 and detects a frame synchronization signal from the extracted bit sequence, as shown in FIG. 7.

Figure 2:
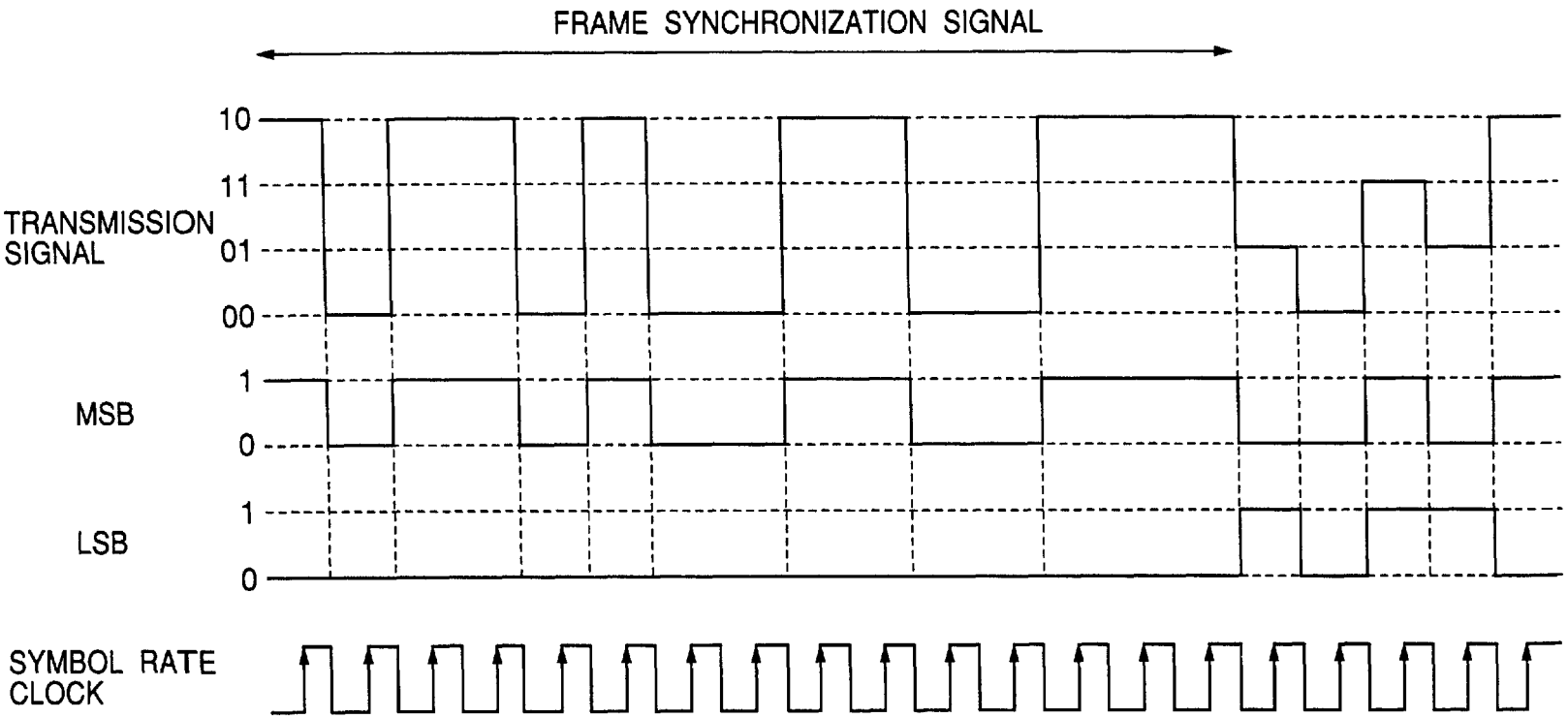
FIG.2 PRIOR ART
FIG. 2 is a timing chart showing frame synchronization pattern detection in the prior art.
Figure 3:
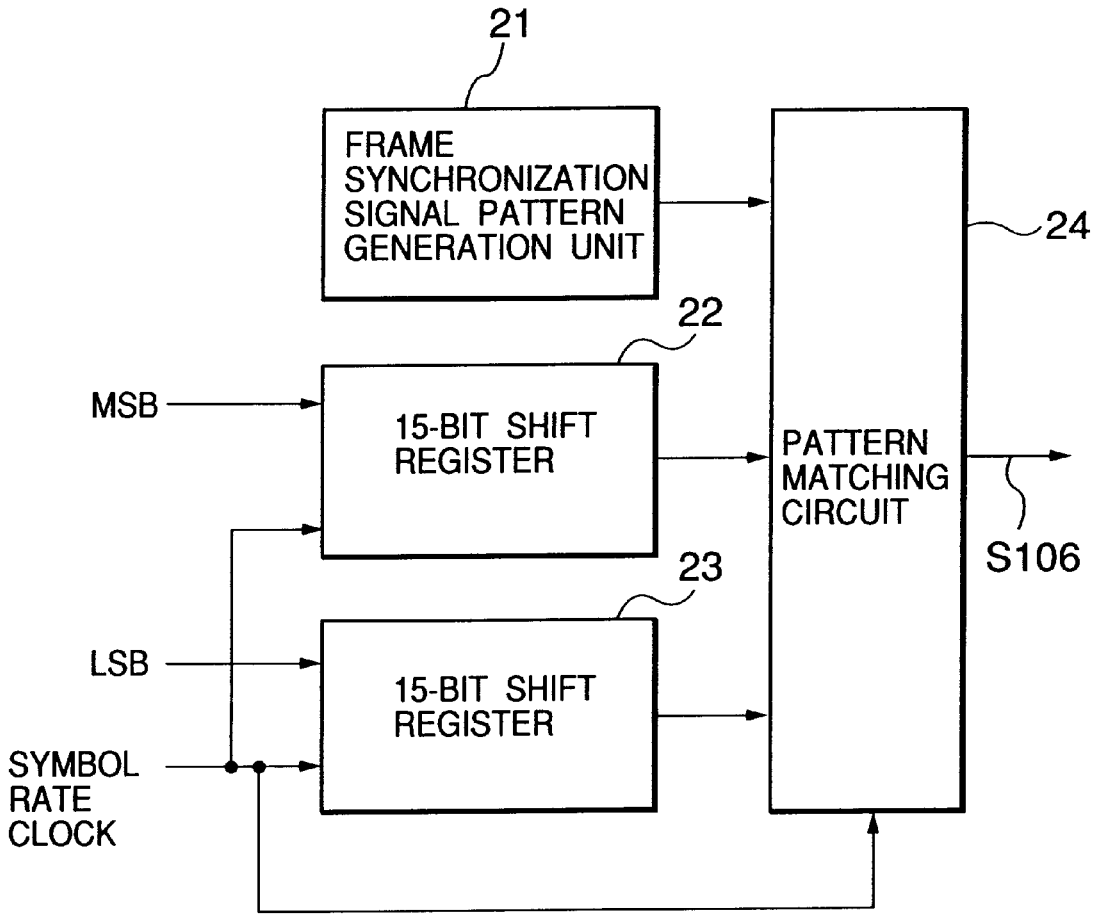
FIG.3 PRIOR ART
FIG. 3 is a block diagram showing a specific arrangement for detecting a frame synchronization pattern in the prior art.

More specifically, a frame synchronization signal "10, 00, 10, 10, 00, 10, 00, 00, 10, 10, 00, 00, 10, 10, 10" is detected from the quarternary transmission signal, as in the above-mentioned prior art shown in FIG. 2. This detection is performed using the same circuit arrangement as the prior art shown in FIG. 3.

When the frame synchronization signal is detected, the synchronization signal detection unit 106 outputs a synchronization signal detection signal S106 as shown in FIG. 7 to the bit synchronization circuit 105, a frame counter unit 108, and the decoder 109, and simultaneously, generates an interruption S103 for synchronization signal detection to a CPU 111. Upon receiving the synchronization signal detection signal S106, the bit synchronization circuit 105 generates a first bit signal S105 which generates a 1-bit wide pulse at the start of each word (=30 bits) at the timing shown in FIG. 7, and supplies the first bit signal to the frame counter unit 108.

The decoder 109 receives, from the CPU 111 through signals S119 and S110, a self call number which has been set in advance in an ID-ROM 118. Upon receiving the synchronization signal detection signal S106, the decoder 109 segments the demodulated signal from the reception unit 104 using the bit-corrected clock S102 supplied from the bit synchronization circuit 105. The decoder 109 performs error detection and correction for the segmented bit sequence in units of words (30 bits). In processing of data received from the individual number code portion or message code portion as shown in FIG. 5D, the self call number received from the CPU 111 or a fixed pattern such as a message end signal is detected in addition to error detection/correction. The error detection result, data (information bit) after correction, and the detection result of the self call number or fixed pattern are supplied to the CPU 111 through the signal S110. These data which are received by the CPU 111 from the decoder 109 will be simply called "received data" hereinafter.

Figure 8:
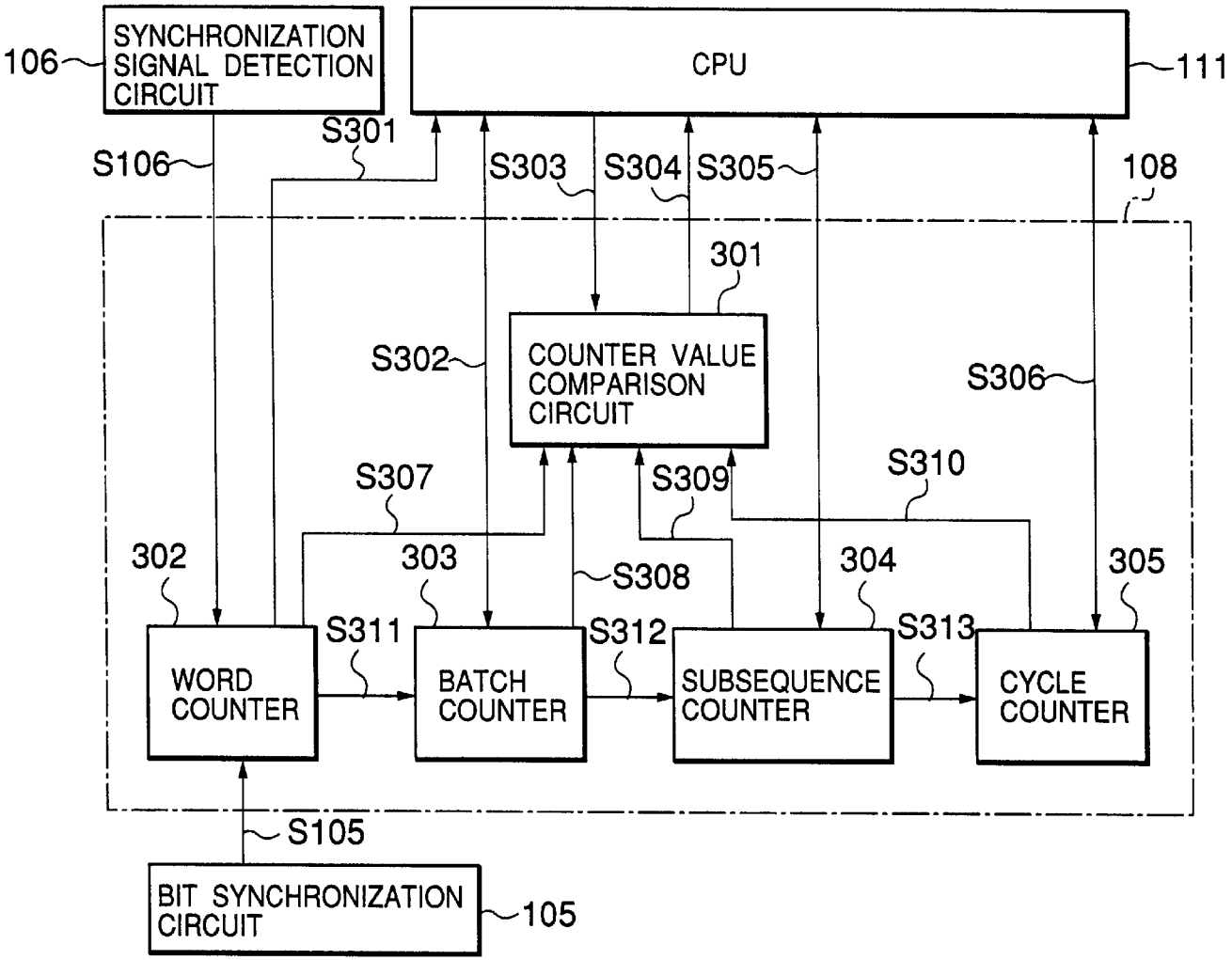
FIG. 8 is a block diagram showing the internal arrangement of a frame counter unit shown in FIG. 4.

When the signal format shown in FIGS. 5A to 5F is to be received, the frame counter unit 108 has an internal arrangement shown in FIG. 8. The frame synchronization signal (synchronization word in FIG. 5F) shown in FIG. 5F is located at the second word from the start of a batch. For this reason, upon receiving the synchronization signal detection signal S106, a word counter 302 is set at "2". The value of this counter 302 is incremented at the leading edge of the pulse of the first bit signal S105. When the count value reaches "99", it returns to "0" in response to the next pulse.

The value of a batch counter 303 is incremented using a pulse S311 generated in returning the count value of the word counter 302 from "99" to "0". When the count value reaches "11", it returns to "0" in response to the next pulse. The value of a subsequence counter 304 is incremented using a pulse S312 generated in returning the count value of the batch counter 303 from "11" to "0". When the count value reaches "4", it returns to "0" in response to the next pulse.

The value of a cycle counter 305 is incremented using a pulse S313 generated in returning the count value of the subsequence counter 304 from "4" to "0". When the count value reaches "59", it returns to "0" in response to the next pulse.

The CPU 111 determines the position of each field in the transmission signal shown in FIG. 5D on the basis of the word counter value from a signal S109. In addition, the CPU 111 sets the counter values of the batch, subsequence, and cycle counters 302 to 305 through the signals S303, S305, and S306 shown in FIG. 8, respectively, on the basis of data received from the frame information portion. The CPU 111 also sets a timepiece unit 119 on the basis of data received from the time information field. Setting of the timepiece unit 119 by the CPU 111 on the basis of the received data will be referred to as "automatic time correction" hereinafter. The signals S301 to S306 shown in FIG. 8 are a signal group constituting the signal S109 shown in FIG. 4.

Referring back to FIG. 4, an operation clock S120 for the timepiece unit 119 is supplied from the reference oscillator 107. The contents of the timepiece unit 119 are fetched by the CPU 111 through a signal S121, so the CPU 111 controls a display driving circuit 112 through a signal S113. A display unit 113 displays the time in accordance with a signal S114.

Upon detecting reception of the self call number from data received from the individual number code portion, the CPU 111 performs predetermined character conversion for data received from the message code portion, i.e., message data for the self call number, and stores the data in a RAM 117 through signals S117 and S118. Simultaneously, the CPU 111 controls a notification driving circuit 114 through a signal S115 and generates a sound from a loudspeaker 115 through a signal S116 (performs notification). The CPU 111 also controls the display driving circuit 112 through the signal S113 such that the received message is displayed on the display unit 113 in accordance with the signal S114.

A key input unit 120 is used by the receiver user to set the timepiece unit 119 through a signal S122 and the CPU 111 or load the received message stored in the RAM 117 into the display unit 113.

Normally, after reception of the interruption S103 for synchronization signal detection from the synchronization signal detection unit 106, the CPU 111 sets, in a counter value comparison circuit 301 shown in FIG. 8, a frame value a predetermined time earlier than that to be received on the basis of frame information to be received by the self receiver, which is set in advance in the ID-ROM 118. The CPU 111 controls an intermittent reception control circuit 110 through a signal Sill such that, when the value set by the CPU 111 matches information of counter values from signals S307, S308, S309, and S310, and an interruption S304 generated from the counter value comparison circuit 301 is received, the reception unit 104 is turned on, and when data reception is to be ended at the frame to be received or the subsequent frame, the reception unit 104 is turned off. Accordingly, the intermittent reception control circuit 110 ON/OFF-controls in accordance with a signal S112.

The program for giving the above-described processing instruction of the CPU 111 is written in a ROM 116. The CPU 111 reads out the program through the signals S117 and S118 and executes processing.

The operation of the radio selective calling receiver according to the first embodiment will be described next in detail with reference to FIGS. 9 and 10.

Figure 9:
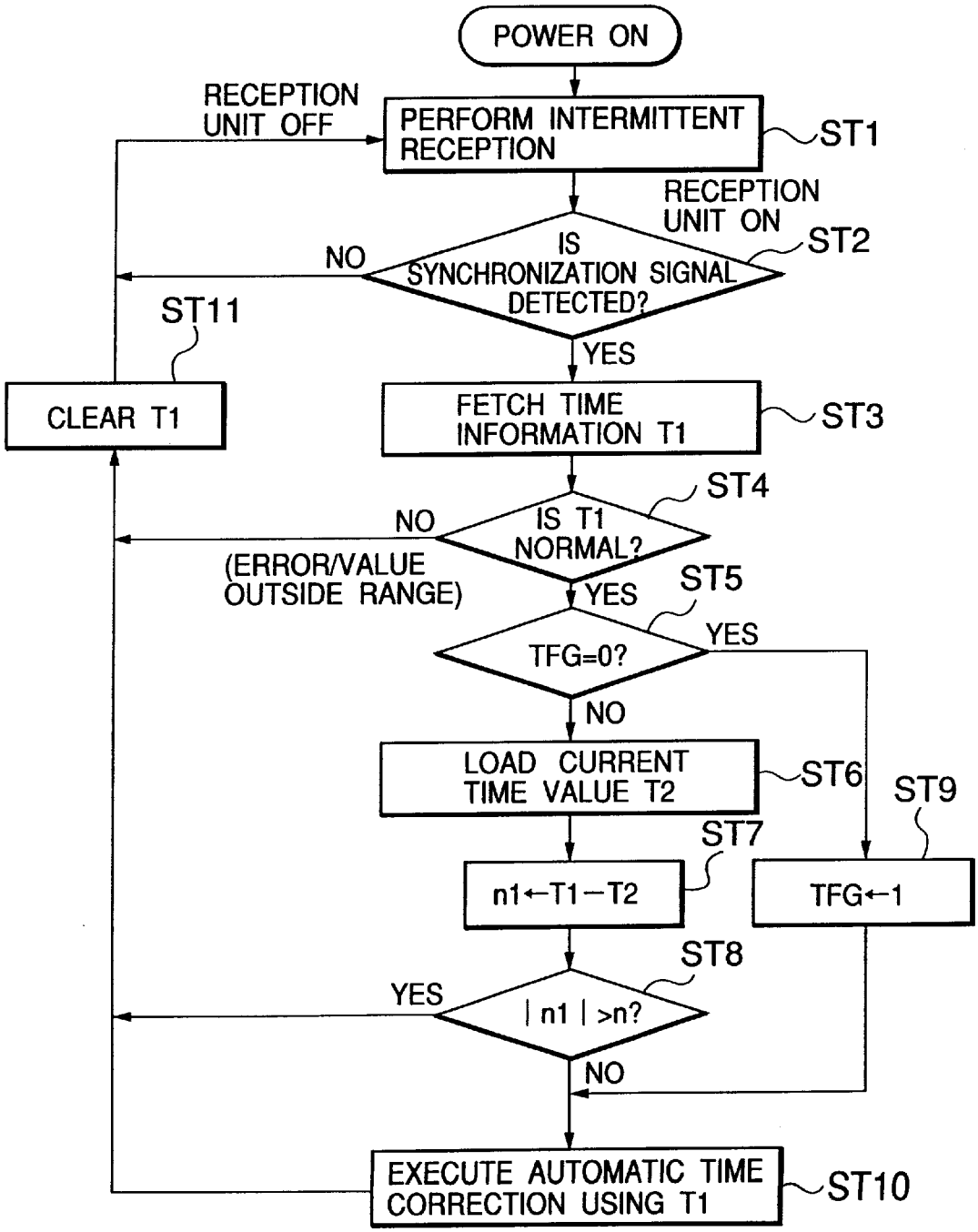
FIGS. 9 and 10 are flow charts showing the automatic time correction of a CPU in the first embodiment.

FIG. 9 is a flow chart showing an example of automatic time correction processing of the CPU 111 shown in FIG. 4 upon receiving the signal having the format shown in FIGS. 5A to 5F. The program of this processing is written in the ROM 116. Although processing of the CPU 111 also includes received message processing and the like, processing operations unnecessary for the description of the present invention are omitted.

A time setting flag TFG in FIG. 9 is set at "0" when the operating voltage for each portion is applied in a reset state of the receiver, e.g., when a battery is inserted for the first time. Thereafter, when the receiver user operates the key input unit 120 to set the timepiece unit 119, or automatic time correction is performed, the time setting flag TFG is set at "1".

After the receiver is powered on, a frame synchronization signal is detected while ON/OFF-controlling the reception unit 104 at a predetermined time interval in ST1 and ST2.

If a frame synchronization signal is detected in ST2, time information T1 and corresponding error information are fetched in ST3. When the time information T1 has an error the number of bits of which can be corrected, the fetched information T1 is information which has already been subjected to error correction by the decoder 109. In this case, the error information is "no error".

It is determined in ST4 whether the fetched time information T1 is normal. When the error information is "error is present", the "second" or "minute" information has a value of 60 to 63, or the "hour" information has a value of 24 to 31, automatic time correction is not performed. If YES in step ST4, the flow advances to ST5.

In ST5, the time setting flag TFG is determined. If TFG=0 (a time has not been set), the time setting flag TFG is set at "1" in ST9, and automatic time correction of the timepiece unit 119 is performed using the fetched time information T1 in ST10.

In ST6, current time information T2 indicated by the timepiece unit 119 is loaded.

In ST7, a difference n1 between the information T1 and the information T2 is obtained.

In ST8, the absolute value of the difference n1 is obtained, and it is determined whether the absolute value is larger than a positive value n stored in the ID-ROM 118 or the ROM 116 in advance. If YES in ST8, automatic time correction is not performed. If NO in ST8, automatic time correction of the timepiece unit 119 is performed using the fetched time information T1 in ST10.

In ST11, the time information T1 fetched this time is cleared.

Figure 10:
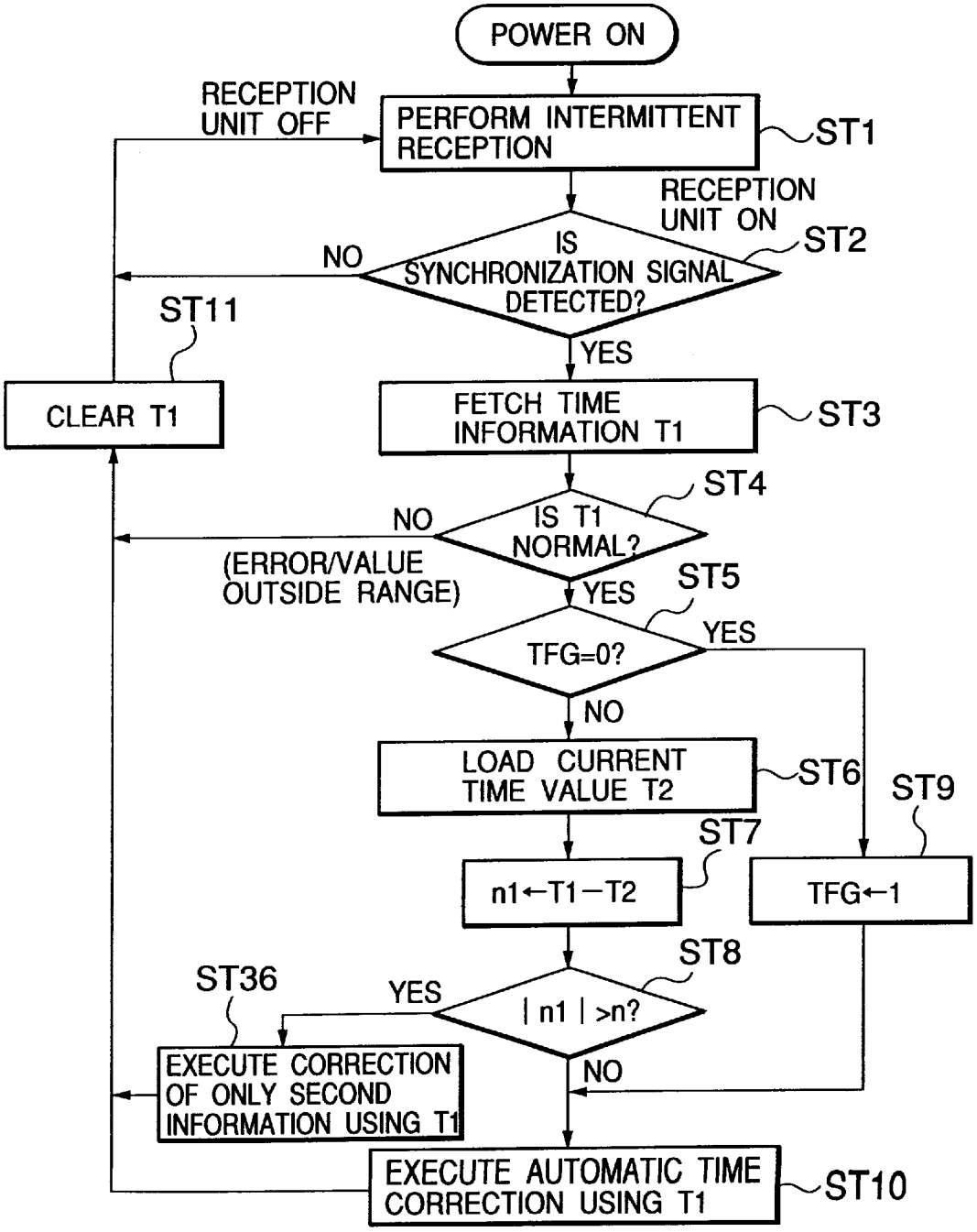

FIG. 10 is a flow chart showing another example of automatic time correction of the CPU 111 shown in FIG. 4, like FIG. 9.

FIG. 10 is characterized in that even when it is determined in ST8 that the absolute value of the difference n1 is larger than the positive value n stored in the ID-ROM 118 or the ROM 116 in advance, only the "second" information of the current time indicated by the timepiece unit 119 is automatically corrected using the information T1 in ST36.

The same symbols as in FIG. 9 denote the same step processing operations in FIG. 10.

Normally, assuming that the radio selective calling receiver receives the format shown in FIGS. 5A to 5F, the receiver performs intermittent reception such that only a specific batch is received in one subsequence shown in FIG. 5A. Even in this case, determination as to whether to perform automatic time correction and automatic time correction based on the determination result are executed once in one cycle, so automatic time correction is not always performed in every received frame. In such a case, when it is determined in ST8 shown in FIG. 9 or 10 that the absolute value of the difference n1 is larger than the positive value n, determination as to whether to perform automatic time correction and processing corresponding to the determination result may be performed in the subsequently received frame. As described above, it is effective to temporarily change the frame where determination of the next automatic time correction is to be performed.

The second embodiment of the present invention will be described next with reference to FIGS. 11 and 12.

Figure 11:
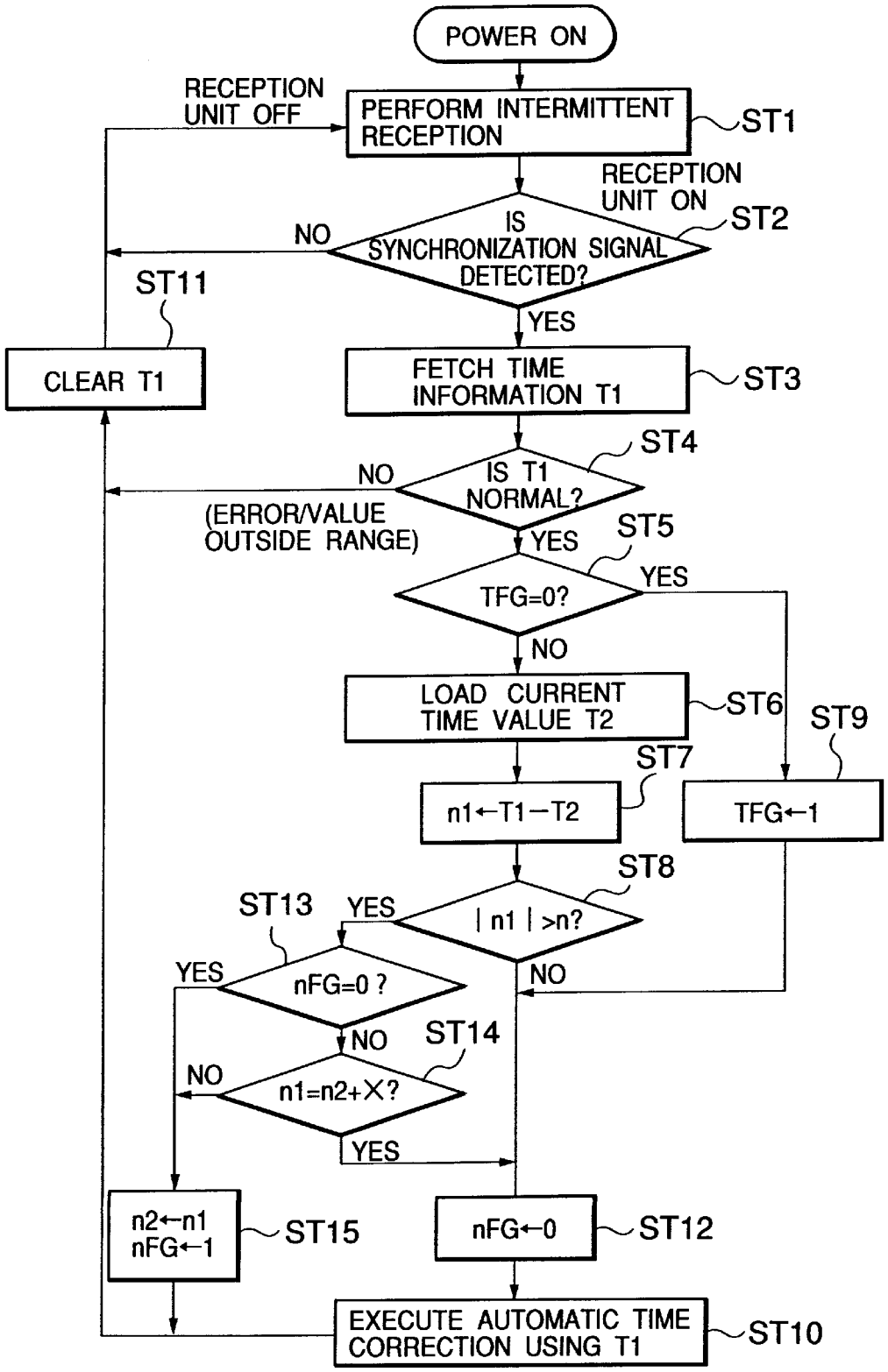
FIGS. 11 and 12 are flow charts showing automatic time correction in the second embodiment of the present invention.

FIG. 11 is a flow chart showing an example of automatic time correction of a CPU 111 shown in FIG. 4, like FIG. 9.

FIG. 11 is characterized in that even when the absolute value of a difference n1 is larger than a predetermined positive value n, automatic time correction is performed using information T1 as far as the value of the difference n1 consecutively falls within the error range of a positive/negative value x stored in advance in an ID-ROM 118 or a ROM 116. A flag nFG in FIG. 11 is set at "0" when the operating voltage for each portion is applied in a reset state of the receiver, e.g., when a battery is inserted for the first time.

If it is determined in ST8 that the absolute value of the difference n1 is larger than the positive value n, the value of the flag nFG is determined in ST13. If nFG=0, the previous difference n1 to be compared with is not present, so the current difference n1 is newly stored as n2 in ST15. The flag nFG is set at "1". Automatic time correction is not performed this time. If nFG=1, it is determined in ST14 whether the value n2 corresponding to the previous n1 equals the current difference n1 within the predetermined range x. If YES In ST 14, the flag nFG is set at "0" in ST12, and then, automatic time correction using the information T1 is executed in ST10. If NO in ST14, the current value n1 is stored as a new value n2 in ST15.

The same symbols as in FIG. 9 denote the same step processing operations in FIG. 11.

Figure 12:
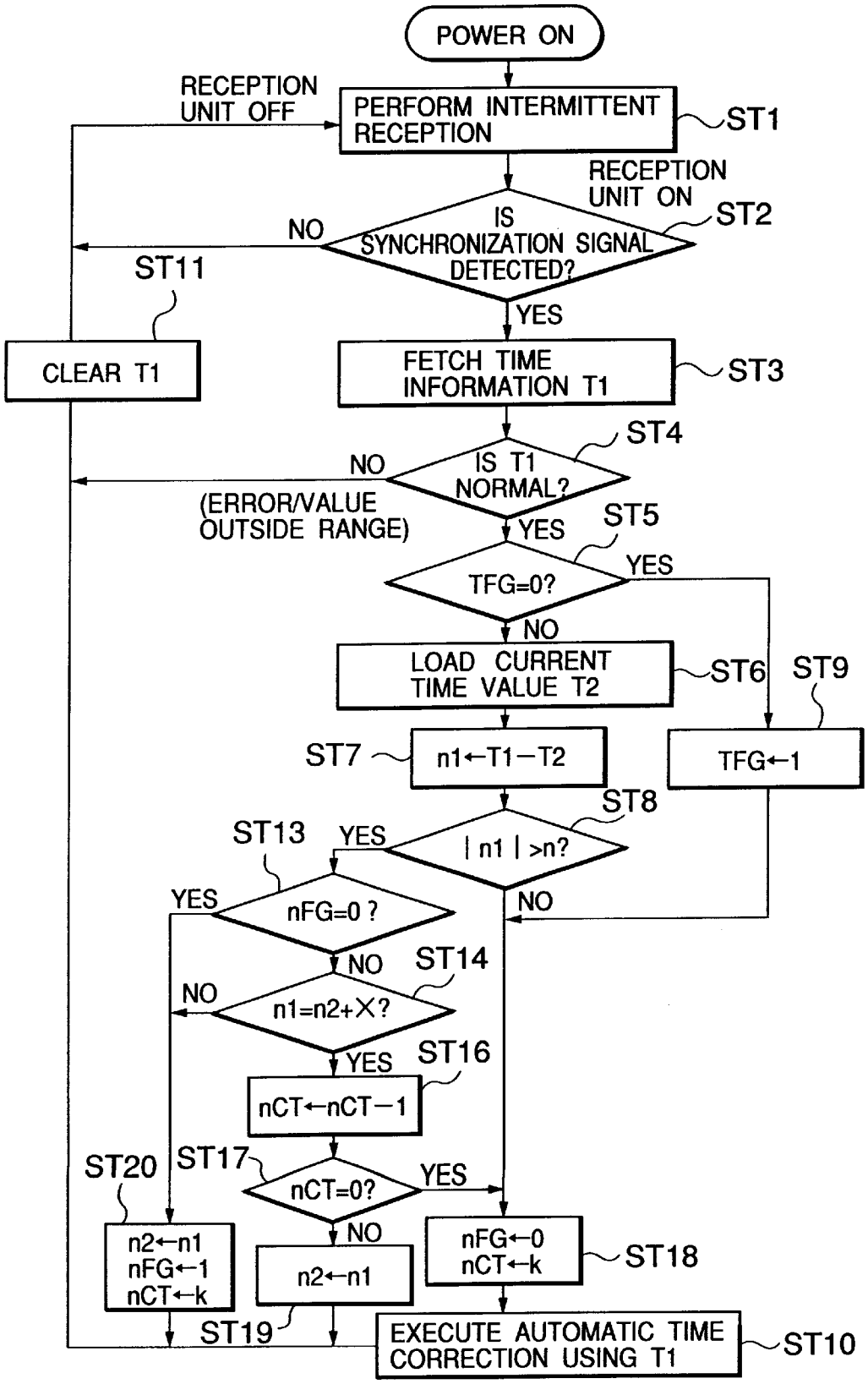

FIG. 12 is a flow chart showing another example of automatic time correction of the CPU 111 shown in FIG. 4, like FIG. 9.

FIG. 12 is characterized in that even when the absolute value of the difference n1 is larger than the predetermined positive value n, automatic time correction is performed using the information T1 as far as the difference n1 continuously falls within the error range of a predetermined positive value x stored in advance in the ID-ROM 118 or the ROM 116 continuously k times. In FIG. 12, the flag nFG is set at "0", and a value nCT is set at "k" when the operating voltage for each portion is applied in the reset state of the receiver, e.g., when a battery is inserted for the first time.

It is determined in ST14 whether n2 as the previous value of n1 equals the current n1 within the predetermined error range x. If YES In ST14, the value nCT is decremented by one in ST16. If NO in ST14, the current n1 is newly stored as n2 in ST20. The flag nFG is set at "1", and the value nCT is se at "k".

In ST17, the value nCT is determined. If nCT≠0, the current n1 is stored as a new value n2. Automatic time correction is not performed this time. If nCT=0, the flag nFG is set at "0", and the value nCT is set at "k" in ST18, and then, automatic time correction is performed using the information T1 in ST10.

The same symbols as in FIG. 11 denote the same step processing operations in FIG. 12.

In FIGS. 11 and 12 as well, it is effective to temporarily change the frame for which automatic time correction determination is to be performed next when it is determined in ST8 that the absolute value of the difference n1 is larger than the positive value n, as in FIGS. 9 and 10.

The third embodiment of the present invention will be described next with reference to FIG. 13.

Figure 13:
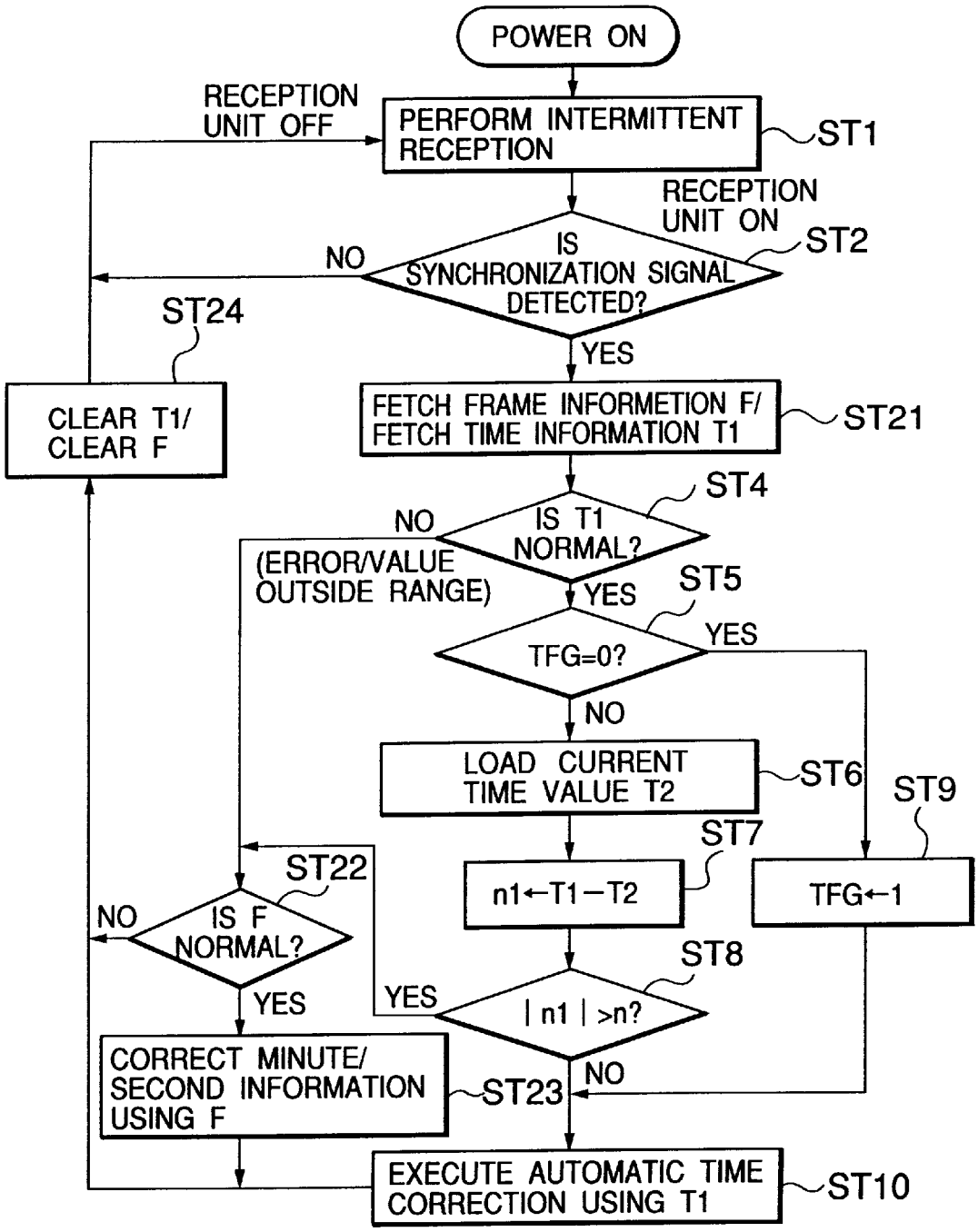
FIG. 13 is a flow chart showing automatic time correction in the third embodiment of the present invention.

FIG. 13 is a flow chart showing an example of automatic time correction processing of a CPU 111 shown in FIG. 4, like FIG. 9. In the signal format to be received, each frame is synchronized with the standard time in the zone of 24 time zones. More specifically, in FIGS. 5A to 5F, each cycle number directly indicates the "minute" information. One sequence time indicates one hour; one cycle time, one minute; one subsequence time, 12 seconds; and one batch time, one second. When the receiver receives, as frame information, Cycle No.=05, Subsequence No.=2, and Batch No.=03, information of "minute" or less is "5 minutes and 27 seconds" although the current "hour" information is unknown.

Referring to FIG. 13, frame information F and time information T1 are fetched from the received frame in ST21. When it is determined in ST4 that the information T1 has a value outside the range of time information or an error, or when it is determined in ST8 that the absolute value of a difference n1 is larger than a predetermined positive value n, it is determined in ST22 whether the frame information F is normal.

If it is determined in ST22 that the information F has a value outside the range as frame information or an error, the information T1 and F1 are cleared in ST24. Automatic time correction is not performed this time. If YES in step S22, only "minute" and "second" information or "second" information is automatically corrected using the information F in ST23.

The same symbols as in FIG. 9 denote the same step processing operations in FIG. 13.

The fourth embodiment of the present invention will be described next with reference to FIGS. 14 and 15.

Figure 14:
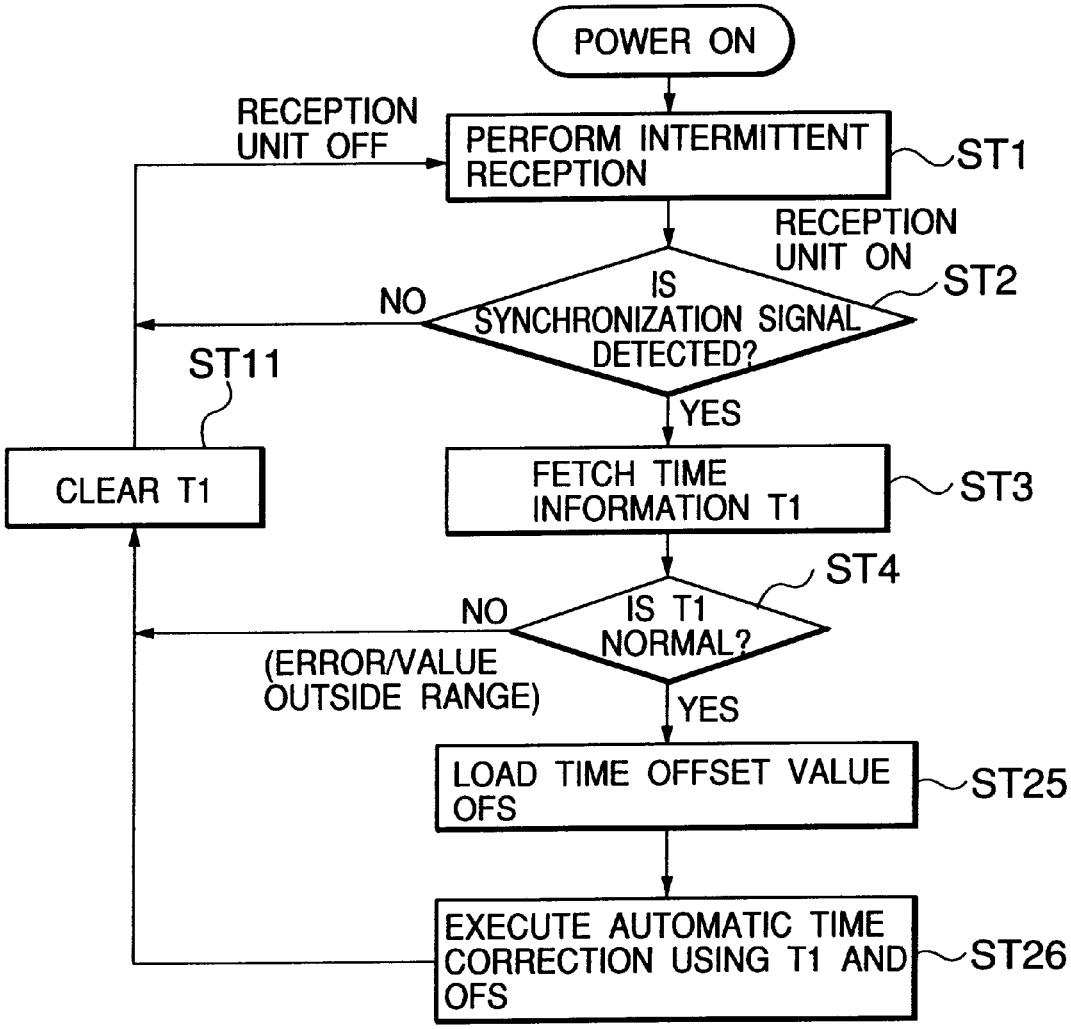
FIGS. 14 and 15 are flow charts showing automatic time correction in the fourth embodiment of the present invention.

FIG. 14 is a flow chart showing an example of automatic time correction processing of a CPU 111 shown in FIG. 4, like FIG. 9.

The flow chart shown in FIG. 14 is characterized in that, in ST26, automatic time correction is performed using time information obtained by adding time information T1 fetched from the received frame to positive/negative offset time information OFS, e.g., information OFS=5 minutes or information OFS=−8 hours, stored in advance in an ID-ROM 118 or a ROM 116. Therefore, the receiver user can always set, in the timepiece unit, a time which is intentionally advanced by five minutes or delayed by eight hours.

If it is determined in ST4 that the information T1 is normal, the information OFS as a positive/negative time offset value stored in advance in the ID-ROM 118 or the ROM 116 is loaded in ST25. In ST26, automatic time correction is executed using time information corresponding to information T1+information OFS. If a carry up to the "hour" or "minute" information or a carry down to the "minute" or "second" information is necessary, automatic time correction is appropriately performed.

The same symbols as in FIG. 9 denote the same step processing operations in FIG. 14.

Figure 15:
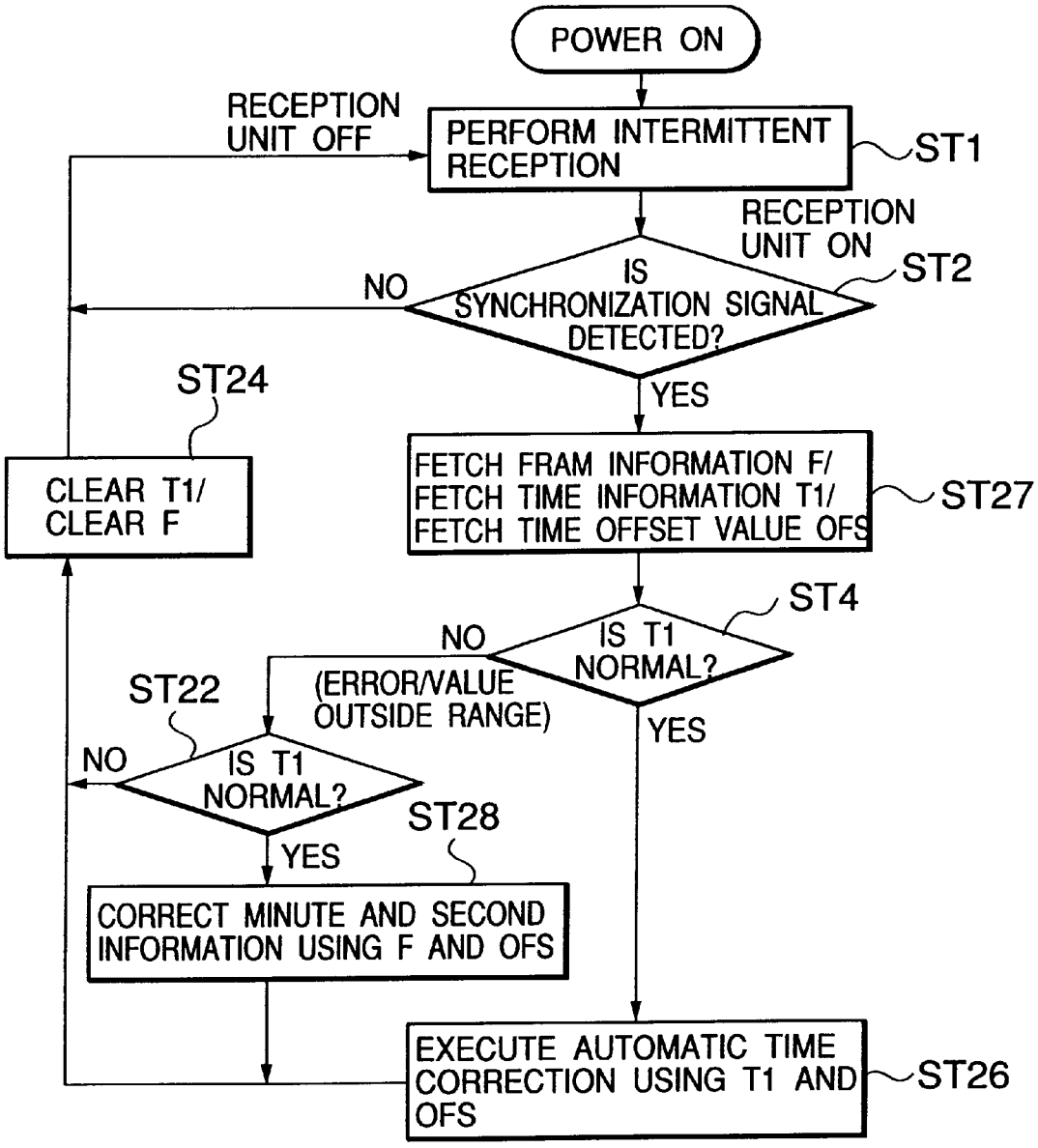

FIG. 15 is a flow chart showing another example of automatic time correction processing of the CPU 111 shown in FIG. 4, like FIG. 9. In this case, in the signal format to be received, each frame is synchronized with the standard time in the relevant zone, as in FIG. 13.

The information OFS as a positive/negative time offset value stored in advance in the ID-ROM 118 or the ROM 116 has a time value smaller than the "minute" unit.

Referring to FIG. 15, in ST27, frame information F and the time information T1 are fetched from the received frame, and the positive/negative offset time information OFS stored in advance in the ID-ROM 118 or the ROM 116 is loaded.

If it is determined in ST4 that the information T1 has a value outside the range of time information or an error, it is determined in ST22 whether the information F is normal. If YES In ST22, automatic time correction is executed using time information corresponding to information F+information OFS. If a carry up to the "hour" or "minute" information or a carry down to the "minute" or "second" information is necessary, automatic time correction is appropriately performed.

The same symbols as in FIGS. 13 and 14 denote the same step processing operations in FIG. 15.

The fifth embodiment of the present invention will be described next with reference to FIGS. 16 and 17.

Figure 16:
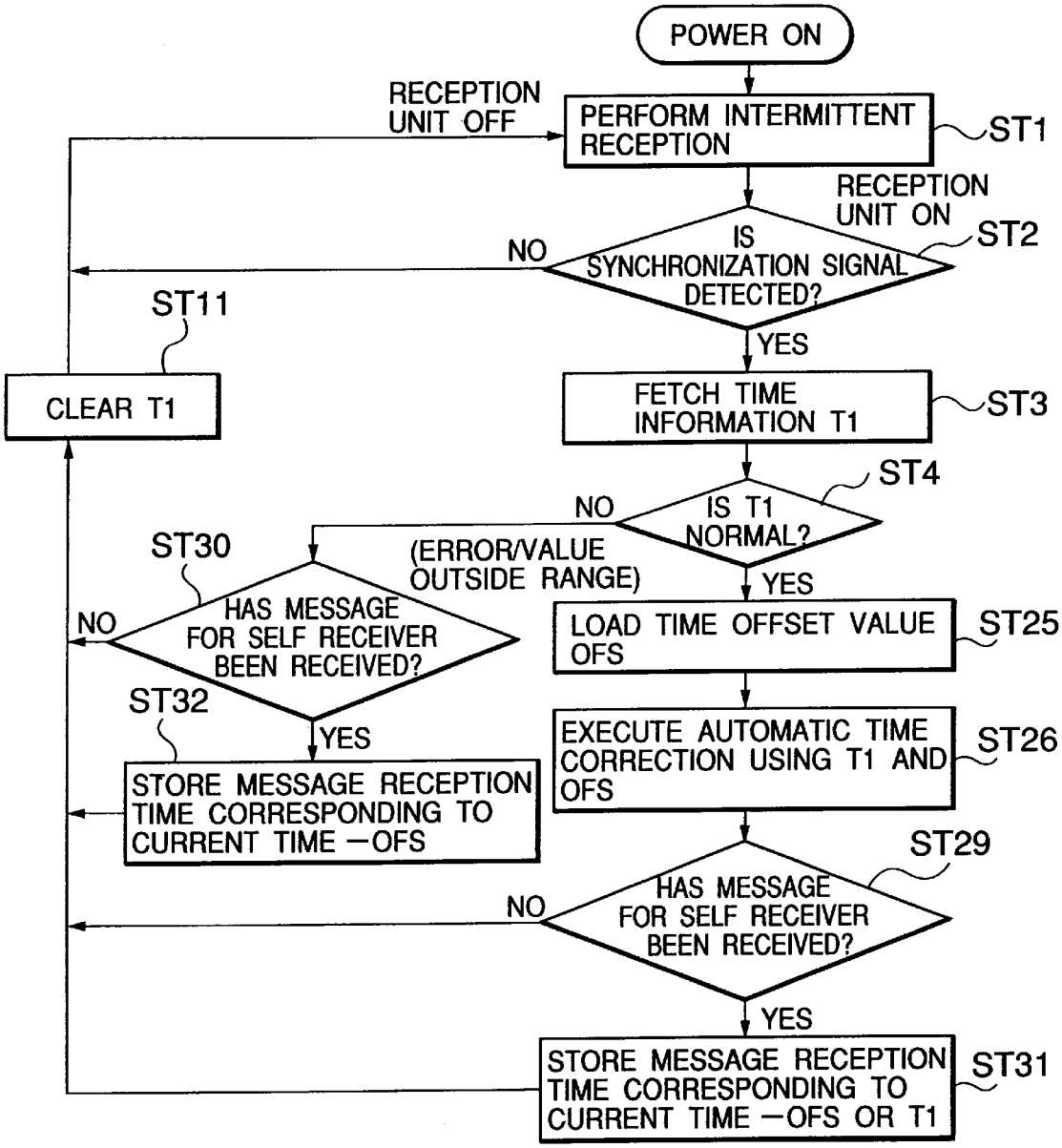
FIGS. 16 and 17 are flow charts showing automatic time correction in the fifth embodiment of the present invention.

FIG. 16 is a flow chart showing an example of automatic time correction processing and received message individual reception time storage processing of a CPU 111 shown in FIG. 4.

FIG. 16 is characterized in that when the receiver user intentionally sets a time shifted from the pertinent standard time in the timepiece unit, the standard time is stored as a received message individual reception time.

If it is determined in ST4 that information T1 has a value outside the range of time information or an error, it is determined in ST30 whether a message for the self receiver has been received in the same or subsequent frame. If YES in ST30, time information obtained by subtracting information OFS from the current time indicated by a timepiece unit 119 is stored as a message reception time in ST32.

Similarly, after execution of automatic time correction in ST26, it is determined in ST29 whether a message for the self receiver has been received in the same or subsequent frame. If YES in ST29, time information obtained by subtracting the information OFS from the current time indicated by the timepiece unit 119, or the time information T1 is stored as a message reception time in ST31.

The same symbols as in FIG. 14 denote the same step processing operations in FIG. 16.

Figure 17:
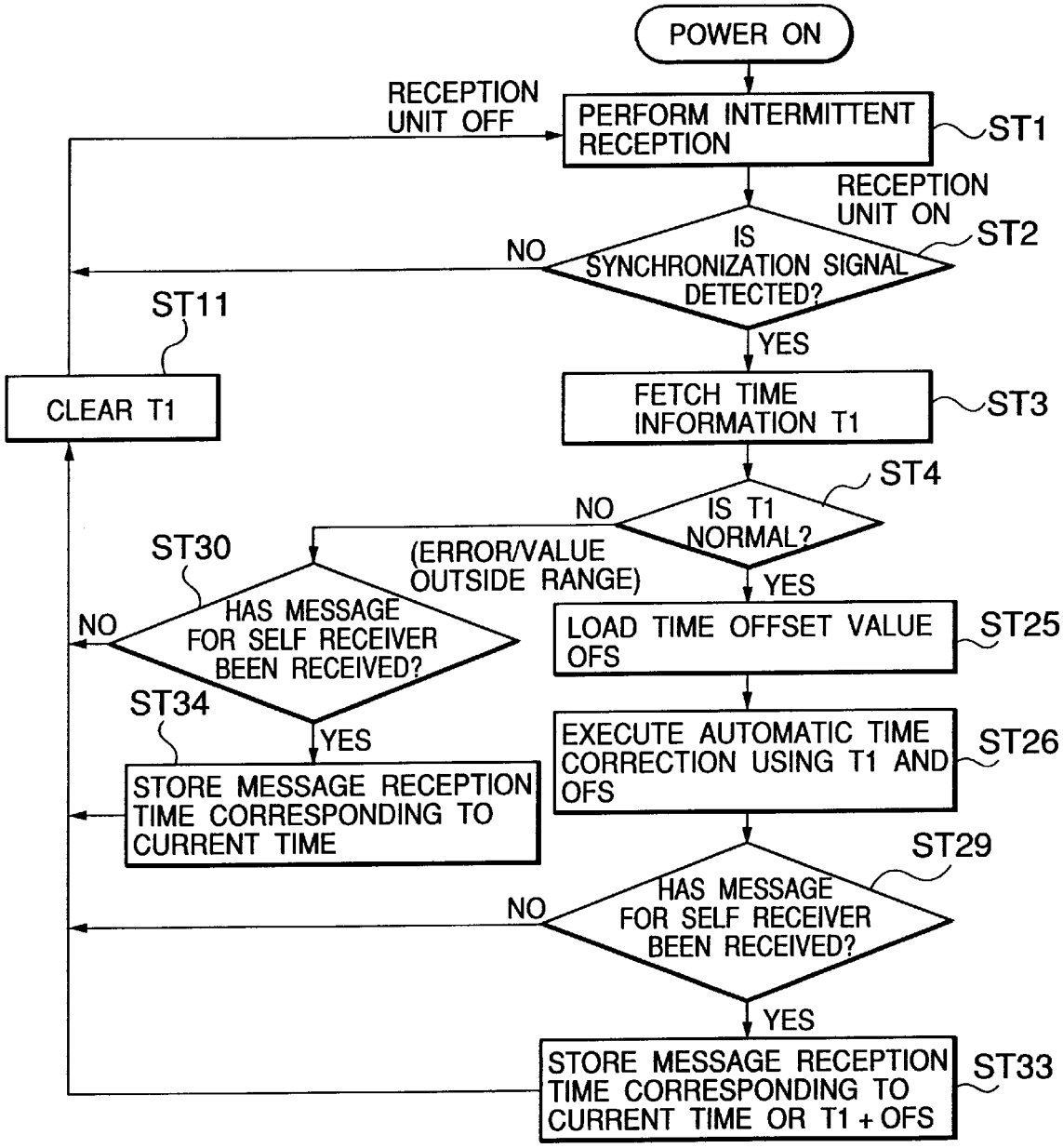

FIG. 17 is a flow chart showing another example of automatic time correction processing and received message individual reception time storage processing of the CPU 111 shown in FIG. 4, like FIG. 16.

FIG. 17 is characterized in that when the receiver user intentionally sets a time shifted from the standard time in the zone in the timepiece unit, the time shifted from the standard time is stored as a received message individual reception time.

If it is determined in ST4 that the information T1 has a value outside the range of time information or an error, it is determined in ST30 whether a message for the self receiver has been received in the same or subsequent frame. If YES in ST30, current time information indicated by the timepiece unit 119 is stored as a message reception time in ST34.

Likewise, after execution of automatic time correction in ST26, it is determined in ST29 whether a message for the self receiver has been received in the same or subsequent frame. If YES in ST29, current time information indicated by the timepiece unit 119, or time information corresponding to information T1+information OFS is stored as a message reception time in ST33.

The same symbols as in FIG. 16 denote the same step processing operations in FIG. 17.

The sixth embodiment of the present invention will be described next with reference to FIGS. 18 and 19.

Figure 18:
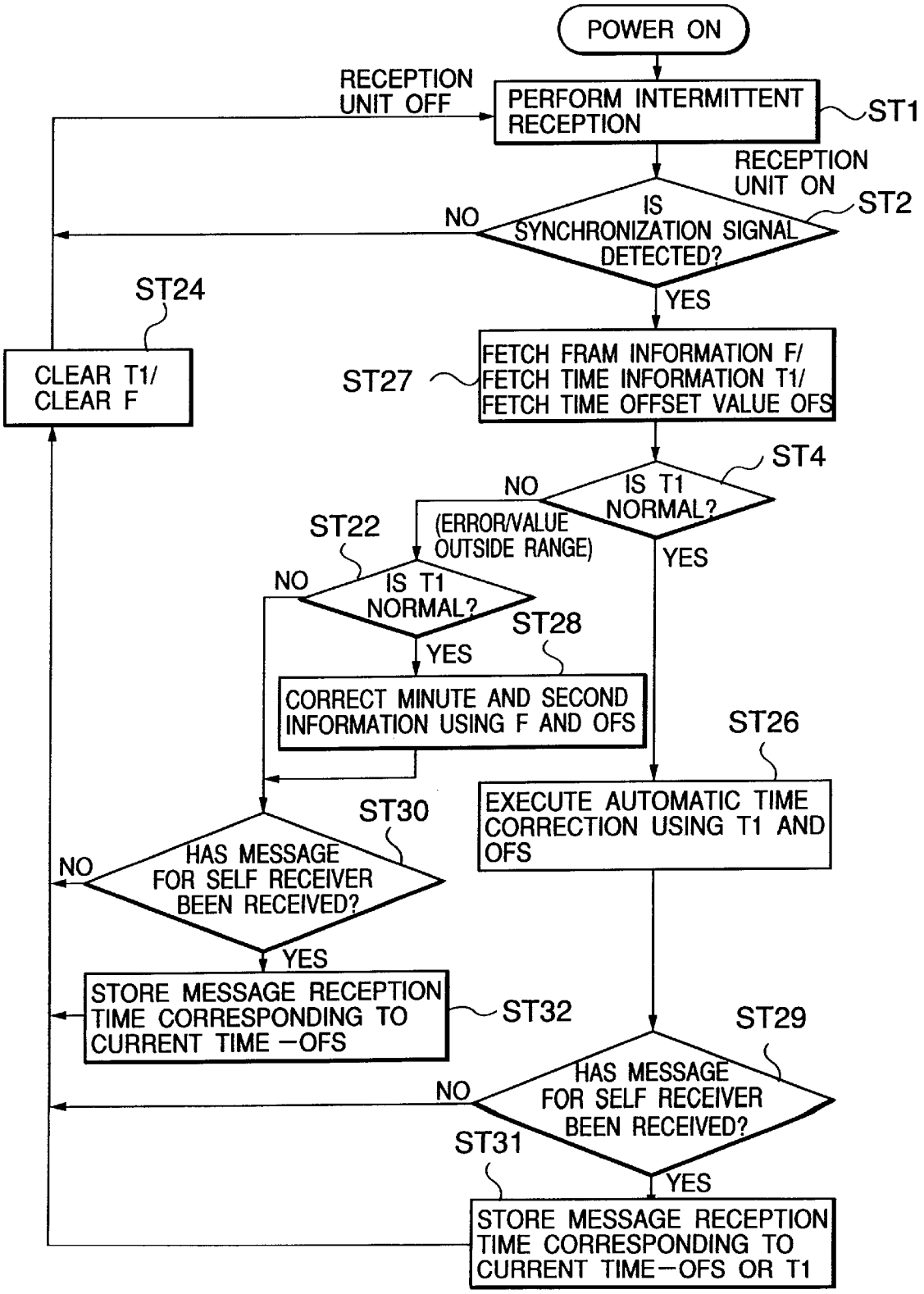
FIGS. 18 and 19 are flow charts showing automatic time correction in the sixth embodiment of the present invention.

FIG. 18 is a flow chart showing an example of automatic time correction processing and received message individual reception time storage processing of a CPU 111 shown in FIG. 4, like FIG. 16. In this case, in the signal format to be received, each frame is synchronized with the standard time in the zone, as in FIG. 13.

FIG. 18 is characterized in that when the receiver user intentionally sets a time shifted from standard time in the timepiece unit, the standard time is stored as a received message individual reception time.

If it is determined in ST22 that information F has a value outside the range of frame information or an error, or if automatic time correction has been performed using the information F and information OFS in ST28, it is determined in ST30 whether a message for the self receiver has been received in the same or subsequent frame. If YES in ST30, time information obtained by subtracting the information OFS from the current time indicated by a timepiece unit 119 is stored as a message reception time in ST32.

In a similar way, after execution of automatic time correction in ST26, it is determined in ST29 whether a message for the self receiver has been received in the same or subsequent frame. If YES in ST29, time information obtained by subtracting the information OFS from the current time indicated by the timepiece unit 119, or time information T1 is stored as a message reception time in ST31.

The same symbols as in FIG. 15 denote the same step processing operations in FIG. 18.

Figure 19:
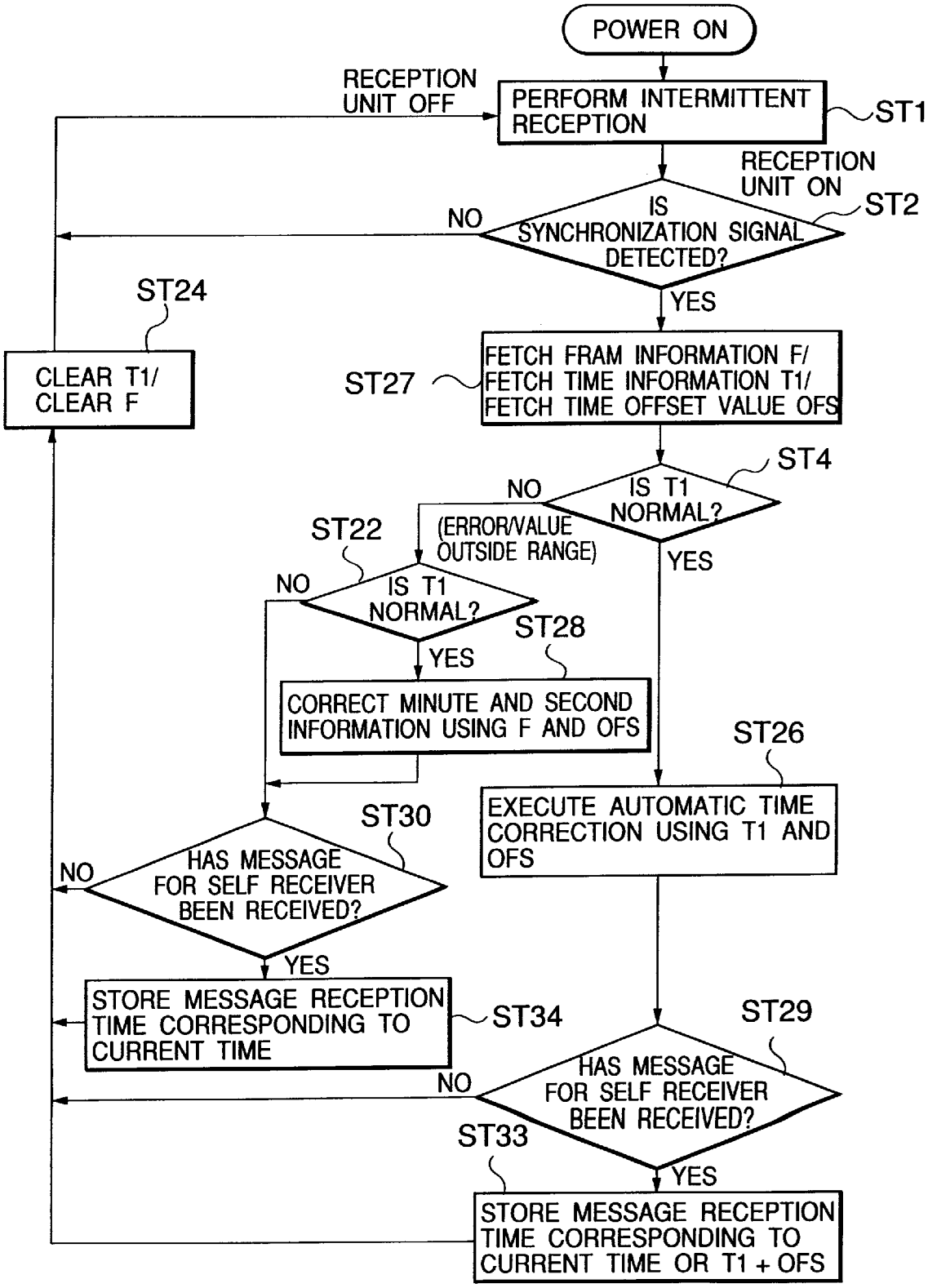

FIG. 19 is a flow chart showing another example of automatic time correction processing and received message individual reception time storage processing of the CPU 111 shown in FIG. 4, like FIG. 18. In the signal format to be received, each frame is synchronized with the standard time in the zone, as in FIG. 18.

FIG. 19 is characterized in that when the receiver user intentionally sets a time shifted from the standard time in the timepiece unit, the time shifted from the standard time is stored as a received message individual reception time.

If it is determined in ST22 that the information F has a value outside the range of frame information or an error, or if automatic time correction has been performed using the information F and the information OFS in ST28, it is determined in ST30 whether a message for the self receiver has been received in the same or subsequent frame. If YES in ST30, current time information indicated by the timepiece unit 119 is stored as a message reception time in ST34.

Again, after execution of automatic time correction in ST26, it is determined in ST29 whether a message for the self receiver has been received in the same or subsequent frame. If YES in ST29, current time information indicated by the timepiece unit 119, or time information corresponding to information T1+information OFS is stored as a message reception time in ST33.

The same symbols as in FIG. 18 denote the same step processing operations in FIG. 19.

The seventh embodiment of the present invention will be described next with reference to FIGS. 20 and 21.

Figure 20:
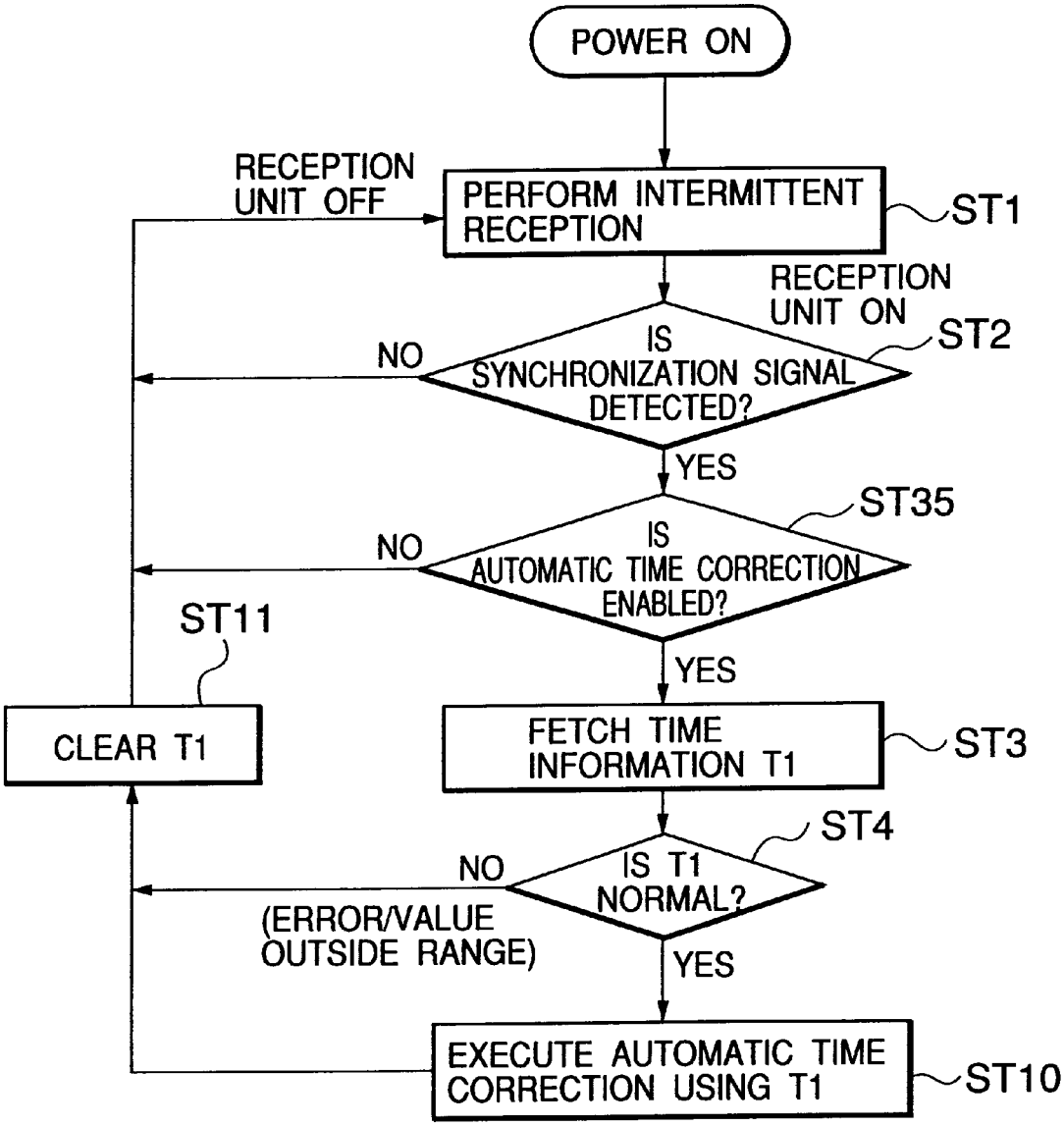
FIG. 20 is a flow chart showing automatic time correction in the seventh embodiment of the present invention.

FIG. 20 is a flow chart showing an example of automatic time correction processing of a CPU 111 shown in FIG. 4, like FIG. 9.

In FIG. 20, it is determined in ST35 whether automatic time correction is enabled. If NO in ST35, automatic time correction is not performed.

The same symbols as in FIG. 9 denote the same step processing operations in FIG. 20.

Figure 1:
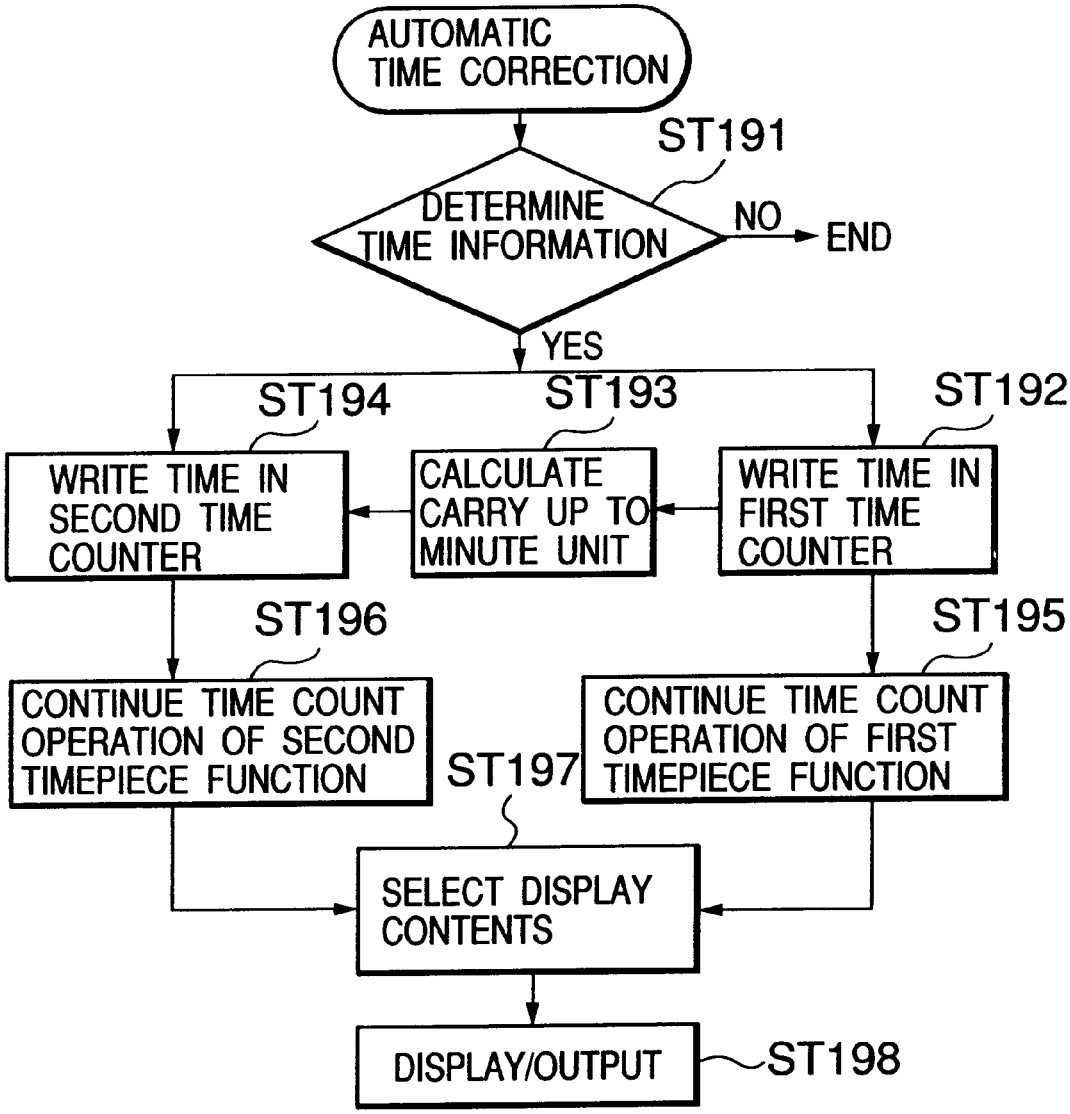
FIG.1 PRIOR ART
FIG. 1 is a flow chart showing time correction of a conventional radio selective calling receiver.
Figure 21:
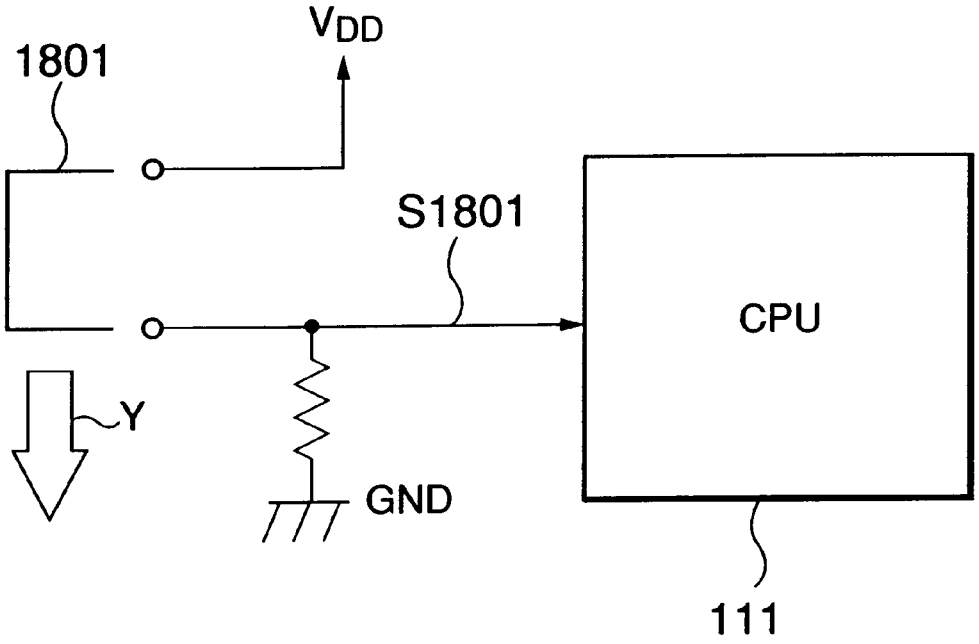
FIG. 21 is a circuit diagram of a device for enabling/disabling the automatic time correction function shown in FIG. 20.

Automatic time correction is enabled/disabled when the receiver user operates a key input unit 120 shown in FIG. 1 or turns on/off a switch 1801 shown in FIG. 21. In FIG. 21, when a signal S1801 is at high level, the CPU 111 recognizes that automatic time correction is enabled. If the signal is at low level, the CPU 111 recognizes that automatic time correction is disabled. The receiver user can switch automatic time correction from the enabled state to the disabled state by sliding the switch 1801 in the direction indicated by an arrow Y shown in FIG. 21. That is, the automatic time correction function is enabled or disabled in accordance with the instruction from the receiver user.

Normally, a value largely shifted from the reference time is not set in the internal timepiece. The time of the internal timepiece may largely vary from the reference time when changed time information is received, and the internal timepiece is corrected on the basis of this information. To prevent this, only when the receiver user wants to correct the internal timepiece, the internal timepiece correction function based on the received reference time information is enabled.

As described above, conventionally, when received time information is to be determined, it is detected only whether the time information has an error or a value outside the range of time information. In the receiver of the present invention, however, the received time information is compared with the time information of the internal timepiece to determine whether the received time information has a value that has changed within the range of time information. Therefore, reliability in internal timepiece correction based on the received time information is improved.

Conventionally, when the receiver user wants to intentionally set a time shifted from the reference time, the receiver must be equipped with a plurality of timepiece functions. In the receiver of the present invention, however, an offset value for the internal timepiece can be set. When the time of the internal timepiece is to be corrected on the basis of the received time information, the time is corrected using information obtained by adding the offset value to the reference time information. With this arrangement, even when a time shifted from the reference time is to be intentionally set by one timepiece function, current consumption can be prevented from increasing.

In the receiver of the present invention, the receiver user can arbitrarily externally enable/disable the internal timepiece correction function based on received time information. With this arrangement, only when the receiver user requires internal timepiece correction, the automatic time correction function can be enabled. Therefore, unlike a case wherein the function is always enabled, internal timepiece correction errors can be prevented.

What is claimed is:

1. A radio selective calling receiver for receiving a signal containing reference time information representing a reference time, comprising:

timepiece means for indicating a time;

comparison means for comparing the reference time represented by the received signal with the time indicated by said timepiece means; and time correction means for correcting the time indicated by said timepiece means on the basis of the reference time only when a time difference value obtained upon comparison is not more than a predetermined set value.

2. A receiver according to claim 1, wherein when the time difference value is larger than the set value, and the large time difference value consecutively falls within a predetermined error range a plurality of number of times, said time correction means corrects the time indicated by said timepiece means on the basis of the reference time.

3. A receiver according to claim 1, wherein said comparison means comprises means for obtaining a difference between the reference time represented by the reference time information contained in at least one specific frame or plural frames of the signal and the time indicated by said timepiece means, and means for changing the specific frame to another frame or other frames when the obtained time difference value is larger than the set value.

4. A receiver according to claim 1, wherein when the time difference value is larger than the set value, said time correction means corrects only a second unit of the time indicated by said timepiece means.

5. A receiver according to claim 1, wherein the signal contains standard time information representing a standard time in a pertinent one of 24 time zones, and said time correction means corrects the time indicated by said timepiece means on the basis of the standard time information when the time difference value is larger than the set value, and corrects the time indicated by said timepiece means on the basis of the reference time when the time difference value is not more than the set value.

6. A receiver according to claim 1, further comprising means for disabling time correction by said time correction means in accordance with an external instruction.

7. A receiver according to claim 1, further comprising offset value storage means for storing an offset value as a difference between the time indicated by said timepiece means and a standard time in a pertinent one of 24 time zones, and wherein said time correction means corrects the time indicated by said timepiece means in accordance with the stored offset value.

8. A receiver according to claim 7, wherein a current time is calculated by subtracting the offset value from the time indicated by said timepiece means when a signal for a self receiver is received.

9. A receiver according to claim 7, wherein a current time is calculated by adding the offset value to the time indicated by said timepiece means when a signal for a self receiver is received.

10. A receiver according to claim 3, wherein the reference time information is contained behind a frame synchronization signal in the specific frame, and further comprising means for detecting the reference time information.

11. A receiver according to claim 6, wherein the external instruction is generated by operating a switch arranged on a housing of a self receiver.

* * * * *